US010822827B1

(12) United States Patent
Yan et al.

(10) Patent No.: US 10,822,827 B1
(45) Date of Patent: Nov. 3, 2020

(54) MULTIFUNCTIONAL RACKS, SUNSHADES AND TENTS ON FLOATING DEVICES

(71) Applicants: Ray Yan, Lake Worth, FL (US); Jing Fu Yan, Lake Worth, FL (US)

(72) Inventors: Ray Yan, Lake Worth, FL (US); Jing Fu Yan, Lake Worth, FL (US)

( * ) Notice: Subject to any disclaimer, the term of this patent is extended or adjusted under 35 U.S.C. 154(b) by 0 days.

(21) Appl. No.: 16/564,915

(22) Filed: Sep. 9, 2019

(51) Int. Cl.

| | |
|---|---|
| ***E04H 15/02*** | (2006.01) |
| ***E04H 15/54*** | (2006.01) |
| ***B63C 9/03*** | (2006.01) |
| ***B63C 9/04*** | (2006.01) |
| ***E04H 15/06*** | (2006.01) |
| ***B63B 17/02*** | (2006.01) |
| ***E04H 15/64*** | (2006.01) |
| ***E04H 15/40*** | (2006.01) |
| ***E04H 15/36*** | (2006.01) |

(52) U.S. Cl.

CPC ..... *E04H 15/06* (2013.01); *B63B 17/02* (2013.01); *B63C 9/03* (2013.01); *E04H 15/02* (2013.01); *E04H 15/36* (2013.01); *E04H 15/40* (2013.01); *E04H 15/64* (2013.01); *B63C 2009/035* (2013.01); *B63C 2009/044* (2013.01); *E04H 15/54* (2013.01)

(58) Field of Classification Search

CPC ..... B63B 17/02; B63B 17/023; B63C 9/03; B63C 2009/026; B63C 2009/035; B63C 2009/044

USPC ..... 135/88.01, 88.13, 96, 98, 115, 124, 125, 135/128, 135, 136, 33.2, 33.41, 119, 135/120.1, 120.3, 159; 114/349, 361; 441/38, 40; 248/160, 288.31, 303, 323, 248/339, 342

See application file for complete search history.

(56) References Cited

U.S. PATENT DOCUMENTS

| | | | | |
|---|---|---|---|---|
| 14,655 A * | 4/1856 | Hartwell | E04H 15/18 | 135/123 |
| 719,899 A * | 2/1903 | Stacey | A41D 15/04 | 2/89 |
| 1,693,536 A * | 11/1928 | Woodley | A45B 15/00 | 135/33.41 |
| 1,855,292 A * | 4/1932 | Kahn | A45B 25/18 | 135/33.41 |

(Continued)

FOREIGN PATENT DOCUMENTS

CH 626794 A * 12/1981

*Primary Examiner* — Robert Canfield

(74) *Attorney, Agent, or Firm* — Fleit Intellectual Property Law; Gary S. Winer; Paul D. Bianco

(57) ABSTRACT

Embodiments of racks are assembled on floating devices to secure mobile devices, foldable sunshades and foldable tents. A rack is composed of rack poles, pole holders, a hub, a cup lock, a pipe connector or a hub bottom screw. The pole holders are fixed around a floating device. The pole top ends may be inserted into the receptacles of a hub. A cup lock may cover the hub to lock the pole top ends in the receptacles. A pipe connector may connect to a hub with its top screw and connect to a mobile device holder or a pouch with its bottom end. Embodiments of foldable sunshades may be secured on the rack with elastic straps and hooks. Embodiments of foldable tents with a bottom hook-side belt of hook-and-loop may bind with a loop-side belt of hook-and-loop fixed on an inflatable raft or boat or on a low-profile hard-hull boat.

19 Claims, 26 Drawing Sheets

(56) References Cited

U.S. PATENT DOCUMENTS 2,163,072 A * 6/1939 Spelman ..... B63B 17/023 414/137.4
2,325,645 A * 7/1943 Livingston ..... E04H 15/26 135/98
2,350,283 A * 5/1944 Levin ..... A45B 25/18 135/33.41
2,531,735 A * 11/1950 Jones ..... A45B 25/18 135/33.41
2,764,766 A * 10/1956 Boyle ..... B63C 9/04 441/38
2,804,633 A * 9/1957 Taylor ..... B63C 9/02 441/38
3,181,542 A * 5/1965 Bareis ..... E04H 15/28 135/98
3,843,983 A * 10/1974 Tangen ..... B63C 9/02 441/38
4,180,867 A * 1/1980 Ridgeway, Jr. ..... A41D 15/04 135/96
4,484,362 A * 11/1984 Asher ..... A41D 3/08 2/69
4,766,918 A * 8/1988 Odekirk ..... E04H 15/02 114/345
4,828,520 A * 5/1989 Baughman ..... B63C 9/04 114/345
5,039,042 A * 8/1991 Zaugg ..... G04B 37/1446 248/115
5,070,807 A * 12/1991 Lewis ..... B63B 17/02 114/345
5,697,320 A 12/1997 Murray
5,718,612 A * 2/1998 Elsholz ..... B63B 17/02 441/38
5,904,114 A 5/1999 Wright
5,927,668 A * 7/1999 Cyrell ..... A47B 81/06 248/316.1
5,930,854 A * 8/1999 O'Neill ..... A47D 13/063 135/135
6,338,356 B1 1/2002 Wallenstatter
6,623,322 B1 * 9/2003 Lesniak ..... B63B 7/085 114/345
6,725,871 B1 4/2004 Shearer
7,111,578 B2 9/2006 Brooks
D560,525 S 1/2008 Skelton
7,418,919 B2 9/2008 Smith
7,424,862 B1 9/2008 Wagner
7,850,130 B2 * 12/2010 Bevirt ..... F16M 13/04 248/127
7,921,862 B1 * 4/2011 Mueller ..... E04H 15/34 135/100
8,360,085 B2 * 1/2013 Lee ..... E04H 15/48 135/135
8,602,662 B1 * 12/2013 Mans ..... F16M 11/40 396/428
8,727,290 B1 * 5/2014 De La Matta ..... F16M 13/00 248/160
9,260,881 B2 2/2016 Lamke
9,440,709 B1 9/2016 Perrone
9,745,021 B1 8/2017 Volakis
2003/0038220 A1 * 2/2003 Catan ..... A47G 29/083 248/304
2004/0211868 A1 * 10/2004 Holmes ..... F16M 11/041 248/231.71
2006/0108485 A1 * 5/2006 Enderle ..... F16M 11/40 248/160
2006/0260668 A1 * 11/2006 Stollar ..... A45B 25/18 135/115
2008/0056808 A1 * 3/2008 Bevirt ..... F16M 11/2078 403/56
2008/0120865 A1 * 5/2008 Smith ..... F26B 25/003 34/239
2009/0108164 A1 * 4/2009 Washio ..... A47G 29/083 248/339
2015/0083175 A1 * 3/2015 Nicheporuck ..... B60J 11/04 135/115
2015/0249730 A1 * 9/2015 Larsen ..... H04M 1/05 29/428
2019/0338553 A1 * 11/2019 Garrison ..... E04H 15/48

* cited by examiner

MULTIFUNCTIONAL RACKS, SUNSHADES AND TENTS ON FLOATING DEVICES

CROSS-REFERENCE TO RELATED APPLICATIONS

Not applicable

STATEMENT REGARDING FEDERALLY SPONSORED RESEARCH OR DEVELOPMENT

Not applicable

FIELD OF THE INVENTION

This invention relates to multifunctional racks, foldable sunshades and foldable tents on floating devices such as inflatable swim rings, rafts or boats, and on low-profile hard-hull boats. This invention also relates to stably secure mobile device holders to multifunctional racks assembled on the floating devices.

BACKGROUND OF THE INVENTION

Many types of support structures and covers are available in the prior arts, such as sunshades, canopies and tents on inflatable rafts or boats, or on hard-hull boats. The examples include, but are not limited to, U.S. Pat. Nos. 9,745,021, 9,440,709, 7,424,862, 7,418,919, 7,111,578, 6,725,871, 6,623,322, 5,904,114, 5,697,320. The prior arts may not be suitable to assemble a multifunctional rack on different floating devices such as inflatable swim rings, rafts or boats, and low-profile hard-hull boats. The prior arts may not be suitable to stably secure mobile device holders to the multifunctional rack assembled on different floating devices. The prior arts may not be suitable to mount a foldable sunshade on the multifunctional rack assembled on different floating devices. The prior arts may not be suitable to mount a foldable tent on the multifunctional rack assembled on an inflatable raft or boat or on a low-profile hard-hull boat. U.S. Pat. No. 6,338,356 disclosed a central suspension ring protruding from a tent top to suspend small objects such as a cellular telephone or a flashlight. The cellular telephone suspended may not stay stable, especially when the cellular telephone is to be used on a floating device. U.S. Pat. No. 6,623,322 disclosed hook-and-loop patches fixed to a lower edge of the inside face of a canopy, each patch corresponding to a hook-and-loop patch fixed to a hull of the vessel. The hook-and-loop patches fixed on the inside face of the canopy cannot form a continuous hook-and-loop binding circle around the vessel to form a sealed tent space on the vessel. U.S. Pat. No. 9,260,881 disclosed a hub structure which fixes the supporting structure members together. However, the supporting structure members are neither easily disassemblable nor flexibly packable.

The invention and application of internet and mobile devices have widely and profoundly changed human life. An online mobile device, such as a smartphone or a tablet computer, may have the functions including communication, entertainment, photography, video recording, video surveillance, instant image transmission, motion detection, location positioning, and travel navigation, etc. The present invention is designed to provide a stable mounting mechanism for a mobile device holder and the like, such as that disclosed in U.S. D560525, on a floating device.

The exemplary embodiments of the present invention can help people relax, tour or camp on the water or on land with a foldable sunshade or a foldable tent while conveniently using a mobile device. The exemplary embodiments of the present invention may be used in the safe areas on the river, lake, reservoir, creek, pond, swimming pool, beach, grass land, marshland or swamp, etc. It is advisable for the users to camp with a foldable tent mounted on a raft or boat in the safe areas on land or on the water, and secure the raft or boat whenever necessary to prevent it from overturn. The foldable tent mounted on a raft or boat may also be used as a temporary outdoor personal shelter. Users may wear life vests whenever necessary.

BRIEF SUMMARY OF THE INVENTION

The disclosed embodiments of the present invention provide examples to assemble multifunctional racks on floating devices such as inflatable swim rings, rafts or boats, and on low-profile hard-hull boats.

The disclosed embodiments of the present invention provide examples to stably secure mobile device holders to the multifunctional rack assembled on different floating devices.

The disclosed embodiments of the present invention provide examples to mount a foldable sunshade on the multifunctional rack assembled on different floating devices.

The disclosed embodiments of the present invention provide examples to mount a foldable tent on the multifunctional rack assembled on an inflatable raft or boat or on a low-profile hard-hull boat.

The disclosed embodiments of the present invention provide examples to bind the foldable tent bottom edge with a hook-and-loop circle fixed on an inflatable raft or boat or on a low-profile hard-hull boat to form a sealed tent space on the raft or boat.

The disclosed embodiments of the present invention provide examples that the multifunctional rack members, foldable sunshades and foldable tents are designed as separate parts, so that they are easily disassemblable, and flexibly packable.

DETAILED DESCRIPTION OF THE INVENTION

The preferred embodiments in the detailed description are for illustrative purposes. The drawings referenced in the description are not necessarily to scale; the dimensions are for illustrative purposes and are not intended to limit the scope of the invention.

The exemplary embodiments of the present invention can help people relax, tour or camp on the water or on land with a foldable sunshade or a foldable tent while conveniently using a mobile device. The exemplary embodiments of the present invention may be used in the safe areas on the river, lake, reservoir, creek, pond, swimming pool, beach, grass land, marshland or swamp, etc. It is advisable for the users to camp with a foldable tent of the disclosure mounted on a raft or boat in the safe areas on land or on the water, and to secure the raft or boat whenever necessary to prevent it from overturn. The foldable tent of the disclosure, mounted on a raft or boat, may also be used as a temporary outdoor personal shelter. Users may wear life vests whenever necessary.

Embodiments of multifunctional racks of the present invention can be assembled on floating devices such as inflatable swim rings, rafts or boats, and on low-profile hard-hull boats. A floating device may support one or more persons. A multifunctional rack is composed of rack poles, pole holders, a hub, a cup lock, a pipe connector or a hub bottom screw. Embodiments of foldable sunshades of the present invention can be secured on the multifunctional rack. Embodiments of foldable tents of the present invention with a bottom hook-side belt of hook-and-loop can bind with a loop-side belt of hook-and-loop fixed on an inflatable raft or boat or on a low-profile hard-hull boat to form a closed tent space on the raft or boat.

1) Rack Poles

Rack poles of the present invention are flexible poles made of fiberglass or other materials. The thickness, strength and length of the rack poles may be designed and made specifically to construct multifunctional racks for supporting different weight loads.

Figure 1B:
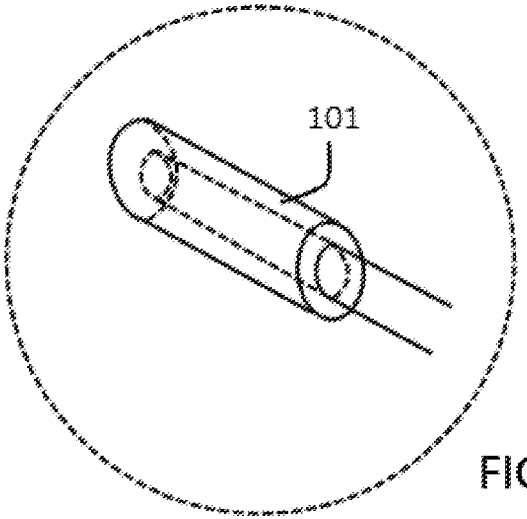
FIG. 1B is an enlarged view of an embodiment of an elastic cup ferrule of a rack pole of the present invention.
Figure 1C:
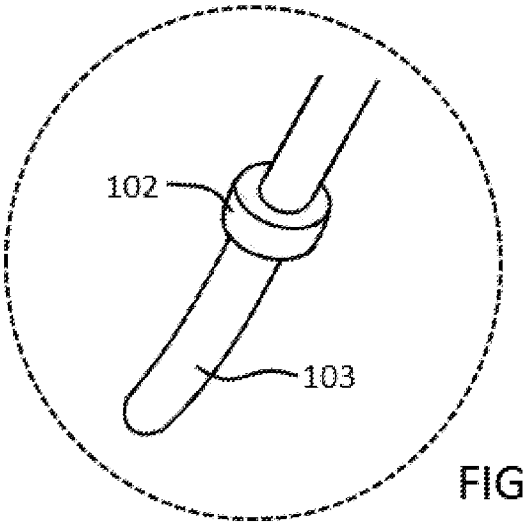
FIG. 1C is an enlarged view of an embodiment of a small knot of a rack pole of the present invention.
Figure 1A:
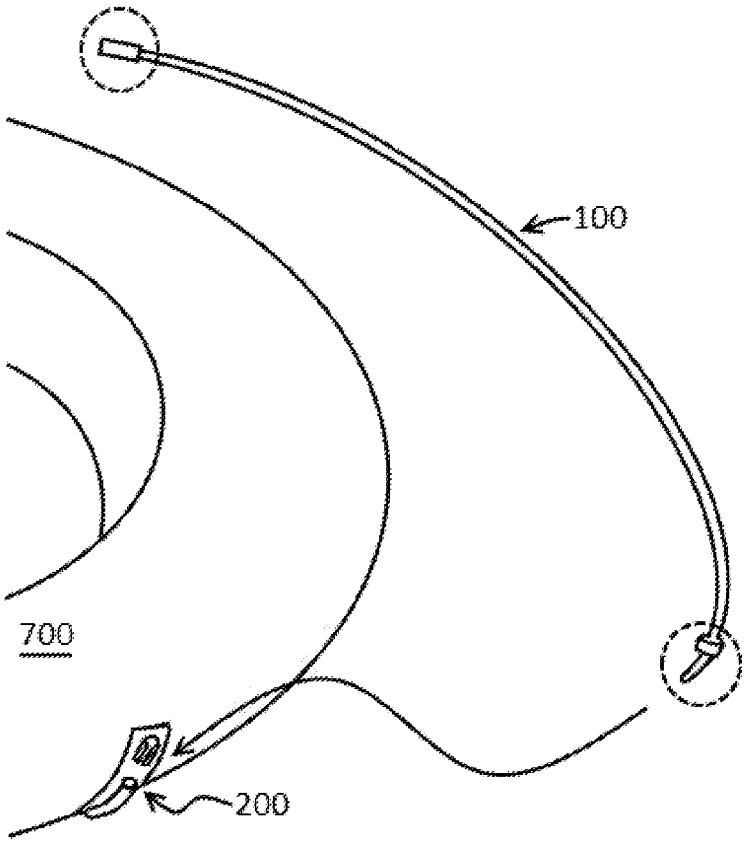
FIG. 1A is a view of an embodiment of a rack pole and a pole holder of the present invention, showing the pole holder is fixed on a swim ring.

FIG. 1A shows the embodiment of a rack pole 100, a part of a swim ring 700, and a pole holder 200 fixed on the swim ring 700. The arrow shows that the rack pole 100 may be inserted into the pole holder 200. An elastic cup ferrule 101 made of rubber or other elastic material is fixed on the top end of a rack pole 100, as shown in the enlarged view of FIG. 1B. The top end of a rack pole may be inserted into a receptacle of a hub, and the elastic cup ferrule 101 may prevent it from sliding out of the receptacle. As shown in the enlarged view of FIG. 1C, a small knot 102, made of the same material as the rack pole or other waterproof material, is fixed near the bottom end of a rack pole 100, forming a bottom section 103 from the small knot 102 to the end of the rack pole, 2) Pole Holders Referring to FIG. 2A, pole holders of the present invention may be made of plastic, rubber or other waterproof material. A base piece of a pole holder may be adhered to, fused to or by other means fixed spaced apart around a floating device to hold the bottom sections of the rack poles. The pole holders may also be molded integrally as parts of a floating device. The top section of a pole holder is a C-shaped blocker to prevent a rack pole from sliding out of the pole holder. There is a vertical narrow opening on the blocker to allow a rack pole to be pushed into or pulled out of the blocker. The narrow opening may be at any position on the blocker. The lower section of a pole holder is a tube with both ends open. The tube is separated from the blocker with a gap. A pole bottom section is longer than the gap but shorter than the tube of a pole holder.

Figure 2B:
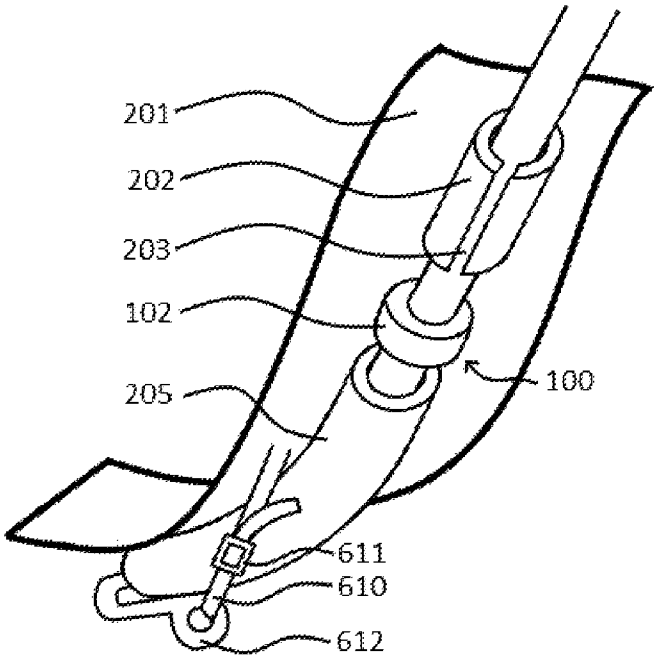
FIG. 2B is a view of an embodiment of a pole bottom section and an embodiment of a sunshade hook of the present invention inserted into the pole holder shown in FIG. 2A.
Figure 2A:
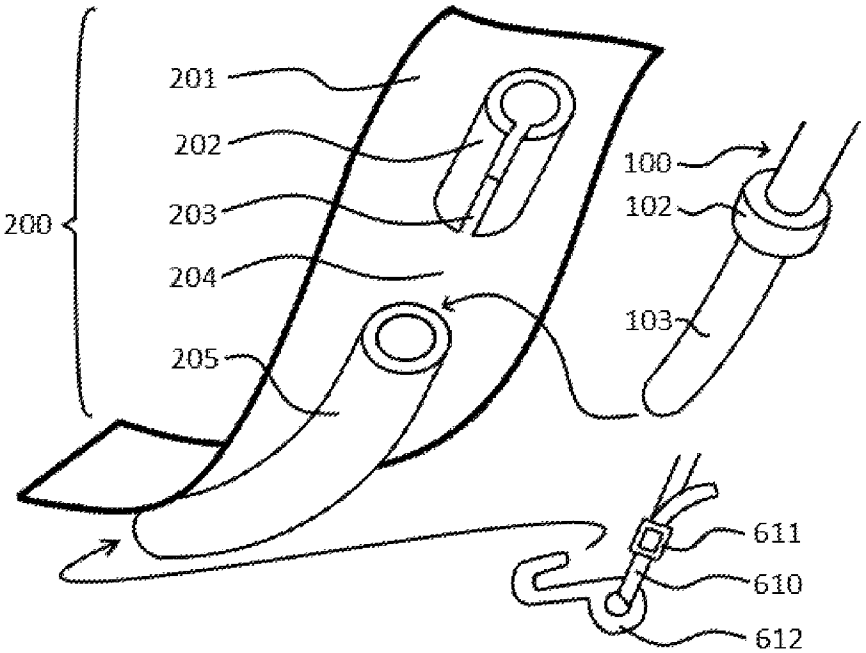
FIG. 2A is a view of an embodiment of a pole holder of the present invention.

FIG. 2A shows the embodiment of a pole holder 200 with a base piece 201, a C-shaped blocker 202 having a narrow opening 203, and a tube 205 separated from the C-shaped blocker 202 with a gap 204. The arrows indicate the ways that the embodiment of a pole bottom section 103 and the embodiment of a hook 612 attached at the end of an elastic strap 610 of a foldable sunshade 600 to be inserted into the tube 205.

FIG. 2B shows that the embodiment of a pole bottom section 103 and the embodiment of a hook 612 are inserted into the embodiment of a pole holder 200 shown in FIG. 2A. The embodiment of a small knot 102 of a rack pole fits in the pole holder gap 204.

3) Hub

Hubs of the present invention are designed to host and hold the rack poles together. Hubs may be made of plastic or other waterproof material. A hub is a cylinder with plural receptacles to host the elastic cup ferrules of the rack poles, and the receptacles are longer than the elastic cup ferrules. The receptacles may be designed in an angle in the range of 0 to 45 degrees downward from the horizontal level. Different hubs may have different number of receptacles, or the receptacles may be in different angles to form different racks for different floating devices.

The top side of a hub is cone-shaped with an umbrella on the top, and a thread column on top of the umbrella. The cone-shaped top and the umbrella form a groove in between, so that the elastic hole of a foldable sunshade or a foldable tent may set into the groove to prevent water from leaking down. The thread column may be used to mount a flag, a surveillance camera or a motion detector, etc. The bottom side of a hub is flat with a center screw hole to connect with a pipe connector or a hub bottom screw.

Figure 3A:
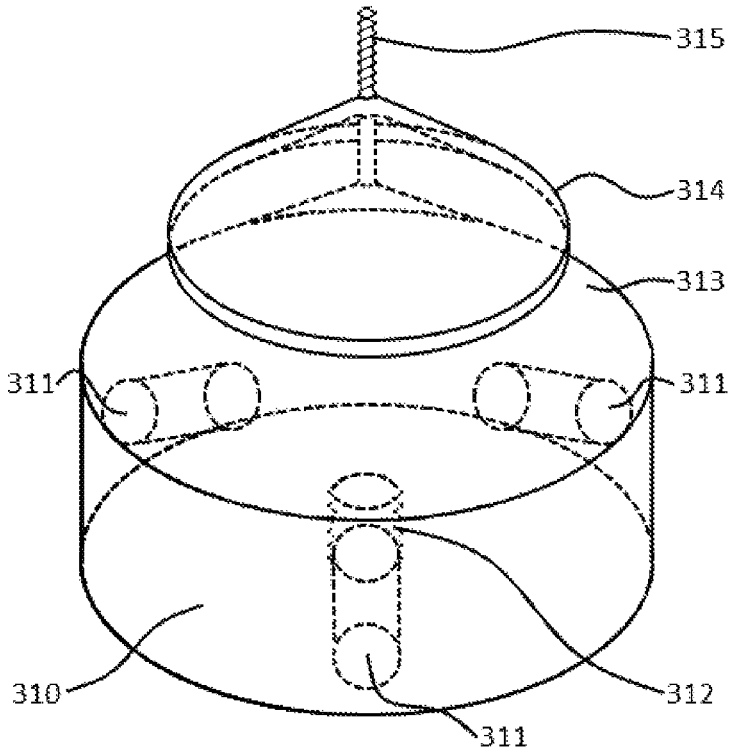
FIG. 3A is a perspective view of an embodiment of a three-receptacle hub of the present invention.
Figure 3B:
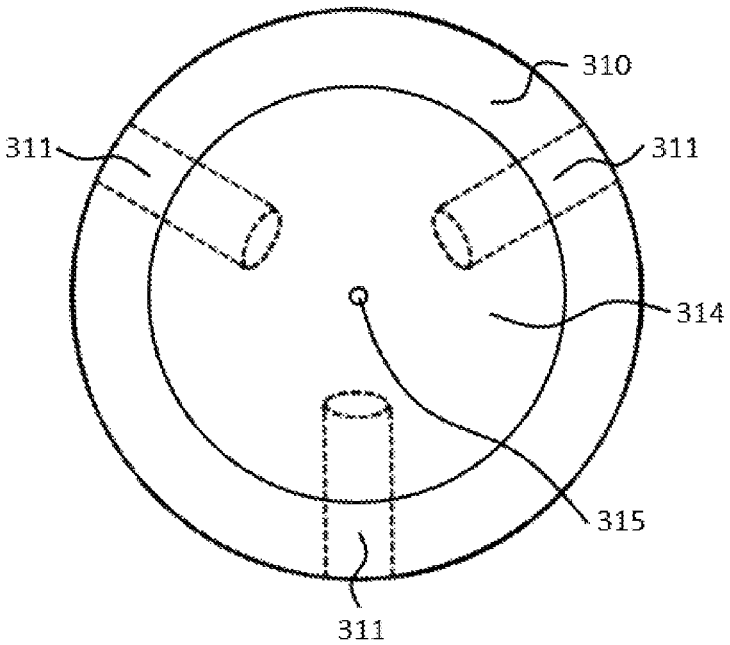
FIG. 3B is a perspective top view of the three-receptacle hub shown in FIG. 3A.

FIG. 3A is a perspective view of the embodiment of a three-receptacle hub 310 to show the receptacles 311, the bottom center screw hole 312, the groove 313, the umbrella 314, and the thread column 315. FIG. 3B is a perspective top view of the embodiment shown in FIG. 3A, to show the receptacles 311, the umbrella 314 and the thread column 315.

Figure 4A:
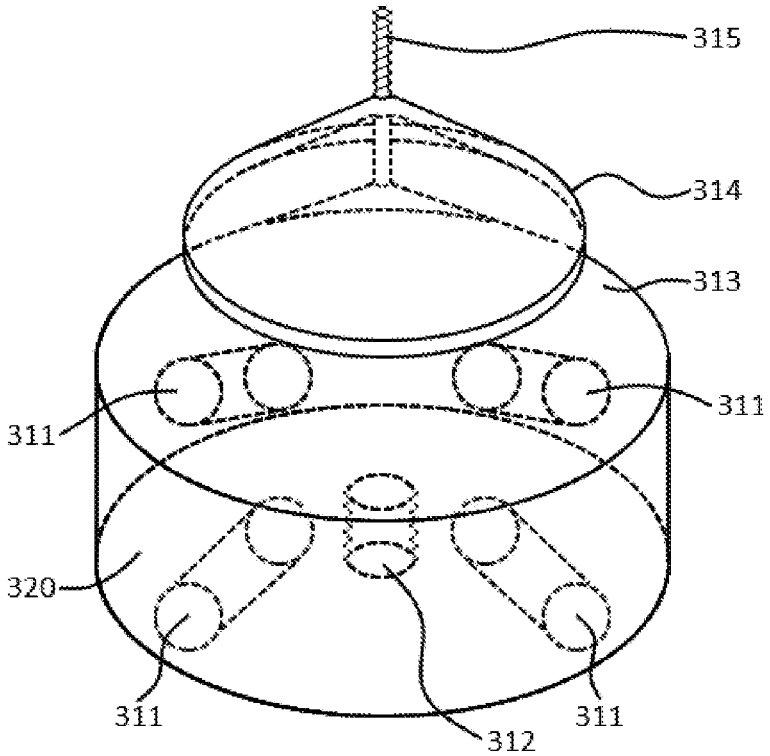
FIG. 4A is a perspective view of an embodiment of a four-receptacle hub of the present invention.
Figure 4B:
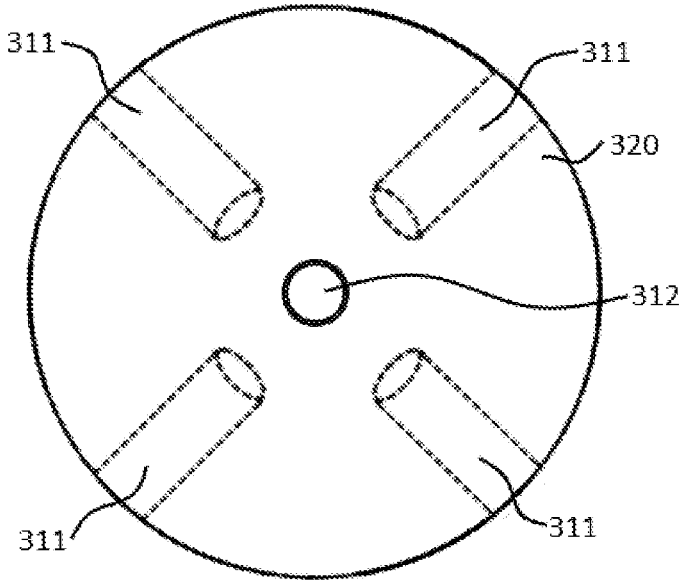
FIG. 4B is a perspective bottom view of the four-receptacle hub shown in FIG. 4A.

FIG. 4A is a perspective view of the embodiment of a four-receptacle hub 320 to show the receptacles 311, the bottom center screw hole 312, the groove 313, the umbrella 314, and the thread column 315. FIG. 4B is a perspective bottom view of the embodiment shown in FIG. 4A, to show the receptacles 311 and the bottom center screw hole 312.

Figure 5A:
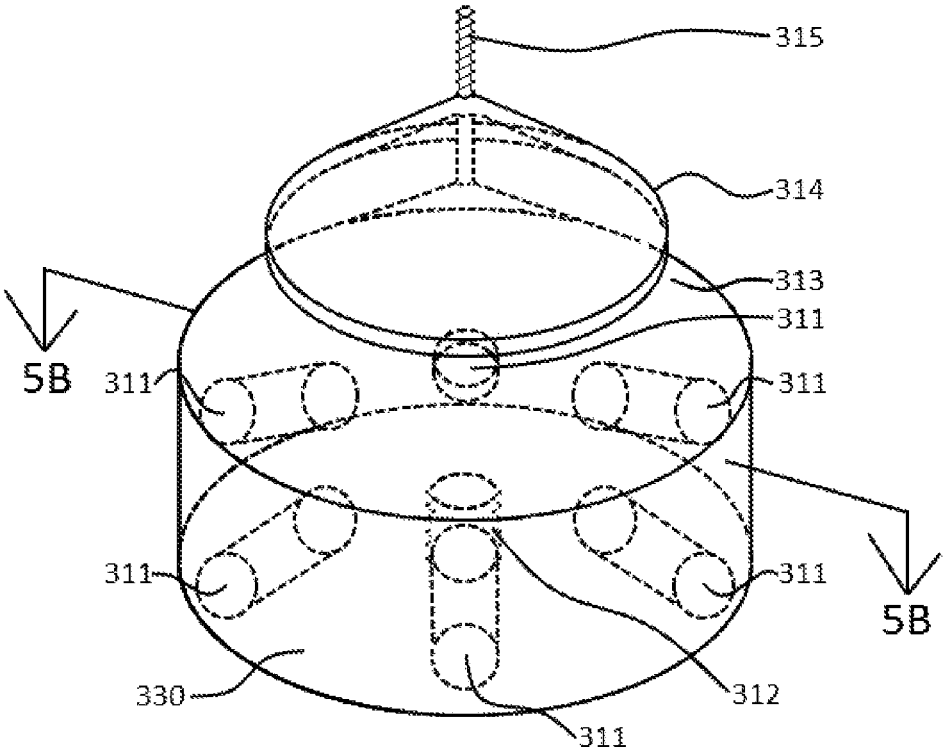
FIG. 5A is a perspective view of an embodiment of a six-receptacle hub of the present invention.

FIG. 5A is a perspective view of the embodiment of a six-receptacle hub 330 to show the receptacles 311, the bottom center screw hole 312, the groove 313, the umbrella 314, and the thread column 315. The section line 5B-5B indicates the cross-sectional view shown in FIG. 5B.

Figure 5B:
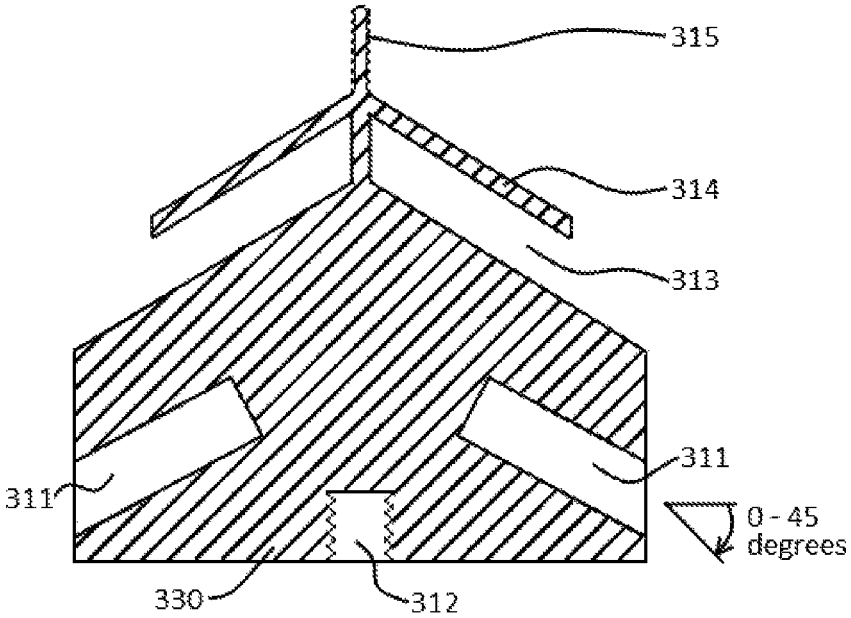
FIG. 5B is a cross-sectional view of the embodiment shown in FIG. 5A, showing that the receptacles may be in an angle in the range of 0 to 45 degrees downward from the horizontal level.

FIG. 5B is a cross-sectional view of the embodiment shown in FIG. 5A, to show the receptacles 311, the bottom center screw hole 312, the groove 313, the umbrella 314, and the thread column 315. It also shows that the receptacles 311 may be designed in an angle in the range of 0 to 45 degrees downward from the horizontal level.

4) Cup Lock

Cup-shaped cup locks of the present invention may be made of plastic or other waterproof material. A cup lock is designed to fit and cover a corresponding hub from the bottom. A cup lock has plural side gaps corresponding to the receptacles of the hub to be covered. The width of the side gaps are larger than the diameter of rack poles, but smaller than the diameter of elastic cup ferrules, so that the side gaps can lock the pole elastic cup ferrules inserted in the hub receptacles. A cup lock has a center hole that is slightly larger than the bottom center screw hole of a hub. The inner side around a cup lock may have an elastic coating layer made of rubber or other elastic material to make the cup lock cover tight on the hub. Different cup locks have different number of side gaps.

Figure 8:
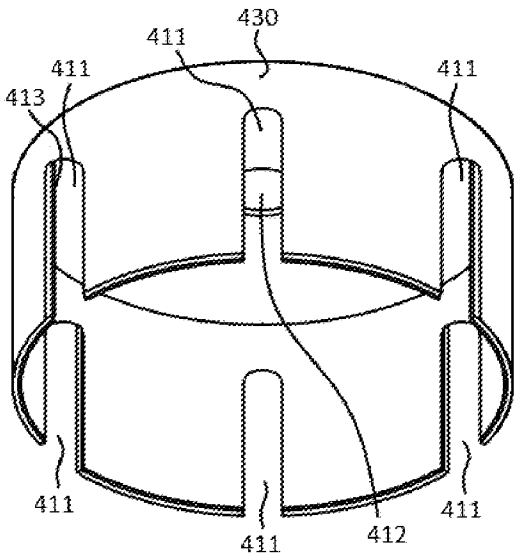
FIG. 8 is a perspective view of an embodiment of a six-gap cup lock of the present invention.
Figure 7:
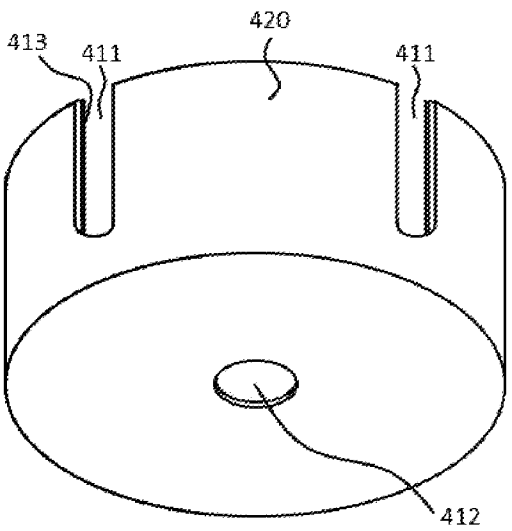
FIG. 7 is a perspective view of an embodiment of a four-gap cup lock of the present invention.
Figure 6:
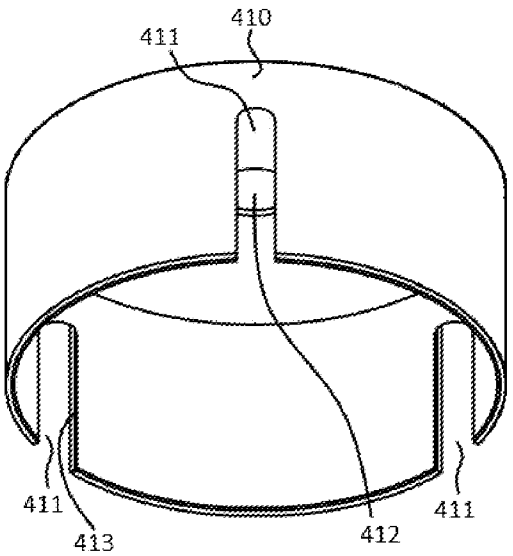
FIG. 6 is a perspective view of an embodiment of a three-gap cup lock of the present invention.

FIG. 6 shows the embodiment of a three-gap cup lock 410 to cover a three-receptacle hub 310, with three side gaps 411, a center hole 412, and an inner side elastic coating layer 413. FIG. 7 shows the embodiment of a four-gap cup lock 420 to cover a four-receptacle hub 320, with four side gaps 411, a center hole 412, and an inner side elastic coating layer 413. FIG. 8 shows the embodiment of a six-gap cup lock 430 to cover a six-receptacle hub 330, with six side gaps 411, a center hole 412, and an inner side elastic coating layer 413.

5) Pipe Connector

A pipe connector of the present invention may be made of plastics, galvanized steel, stainless steel, or a combination of rust-resistant materials. A pipe connector has a top screw fixed on the top of a flexible pipe, and a bottom ball fixed at the end of the flexible pipe. The top screw of the pipe connector is designed to be screwed into a bottom center screw hole of a hub. The flexible pipe can be folded into different shapes and can maintain the folded conformation. The bottom ball of a pipe connector may be connected to a mobile device holder with a ball joint. A mobile device pouch with a strap may be directly tied on a pipe connector.

6) Hub Bottom Screw

A hub bottom screw of the present invention made of plastic or other waterproof material is designed to be screwed into a bottom center screw hole of a hub.

Figure 9:
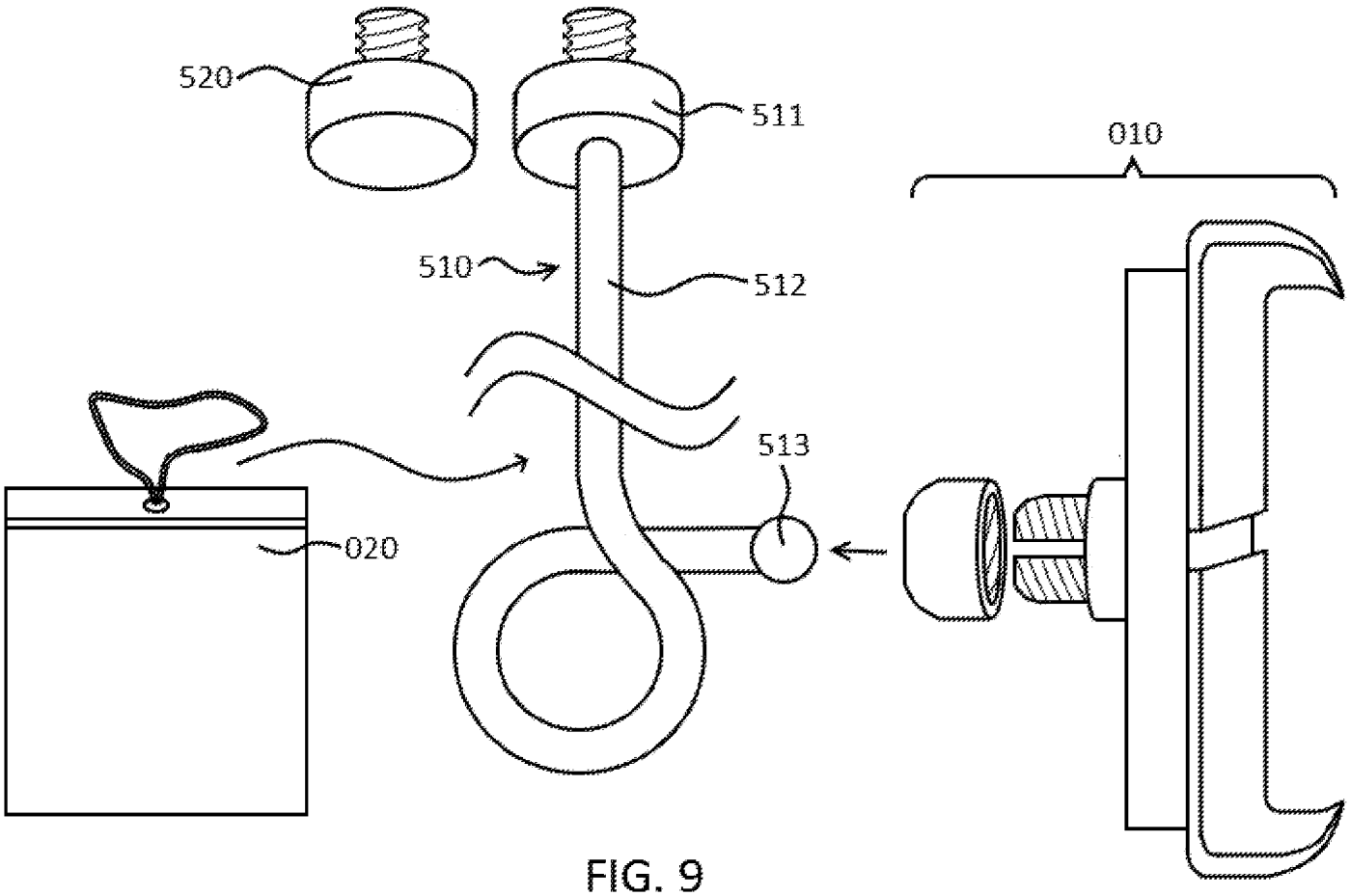
FIG. 9 is a perspective view of an embodiment of a pipe connector of the present invention. It also shows a schematic drawing of a mobile device holder with a ball joint, and a schematic drawing of a mobile device pouch with a strap.

FIG. 9 shows the embodiment of a pipe connector 510 with a top screw 511 fixed on the top of a flexible pipe 512, and a bottom ball 513. It also shows a hub bottom screw 520, a schematic drawing of a mobile device holder 010 with a ball joint, and a schematic drawing of a mobile device pouch 020 with a strap.

7) Assemble a Multifunctional Rack on a Floating Device

Pole holders 200 may be fixed spaced apart around a floating device. Referring to FIG. 2A, first insert a bottom section 103 of a rack pole obliquely into the tube 205 of a pole holder through the top opening, while a small bottom section of the tube 205 is still left empty, as the bottom section 103 of a rack pole is shorter than the tube 205 of a pole holder. Then push the inserted pole 100 through the narrow opening 203 into the blocker 202 of the pole holder, fitting the small knot 102 of the rack pole in the gap 204 of the pole holder. FIG. 2B shows the embodiment of a bottom section 103 of a rack pole and a hook 612 of a foldable sunshade inserted into the tube 205, and the small knot 102 fitting in the gap 204 of the pole holder.

Figure 10:
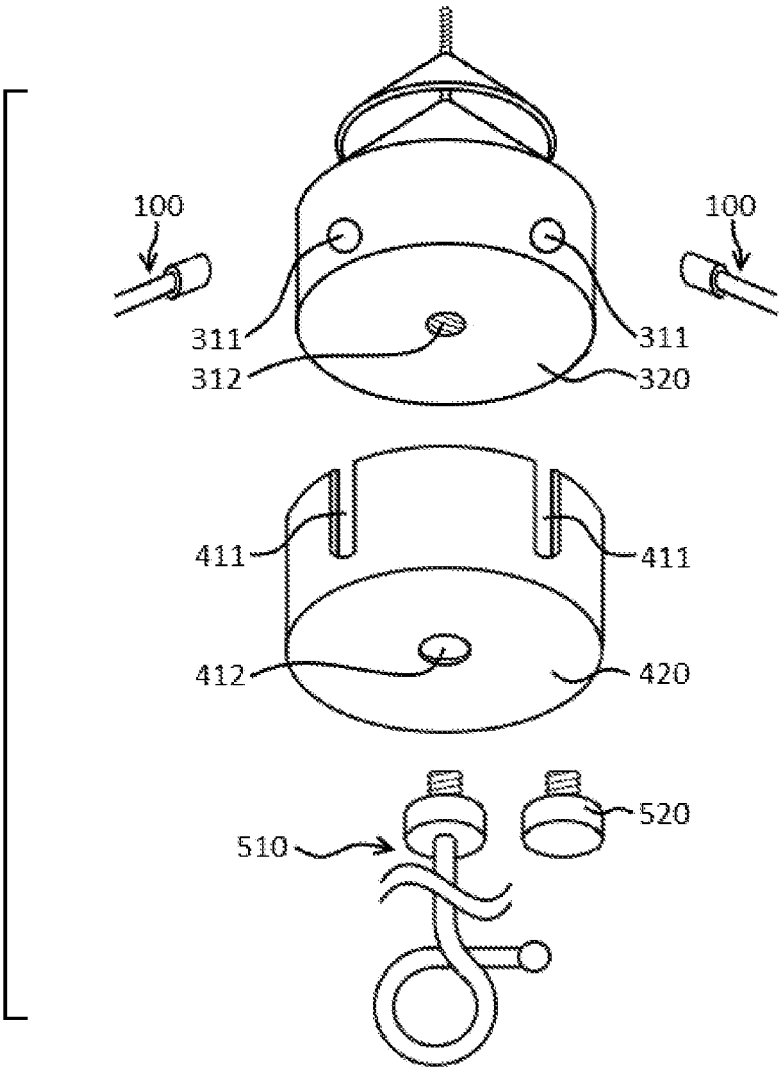
FIG. 10 is a perspective view of the lineup of the embodiments of the present invention for a four-pole rack except for the pole holders.

Use a hub with at least the number of receptacles to host the poles held by the pole holders fixed on the floating device, a corresponding cup lock with the same number of side gaps as the number of receptacles of the hub, and a pipe connector or a hub bottom screw to assemble the rack. FIG. 10 shows the lineup of the embodiments of the members for assembling a four-pole rack except for the pole holders, including rack poles 100, a four-receptacle hub 320, a four-gap cup lock 420, a pipe connector 510 and a hub bottom screw 520.

To assemble the lineup members shown in FIG. 10, insert the elastic cup ferrules 101 of the poles 100 into the receptacles 311 of the hub 320, ensuring the elastic cup ferrules 101 not sliding out of the receptacles. Align the side gaps 411 of the cup lock 420 with the corresponding receptacles 311 of the hub 320; push the cup lock 420 to cover the hub 320 from the bottom to lock the inserted elastic cup ferrules 101 in the receptacles 311. The elastic coating layer 413 on the inner side of the cup lock 420 makes the cup lock 420 to cover tightly on the hub 320.

Figure 11:
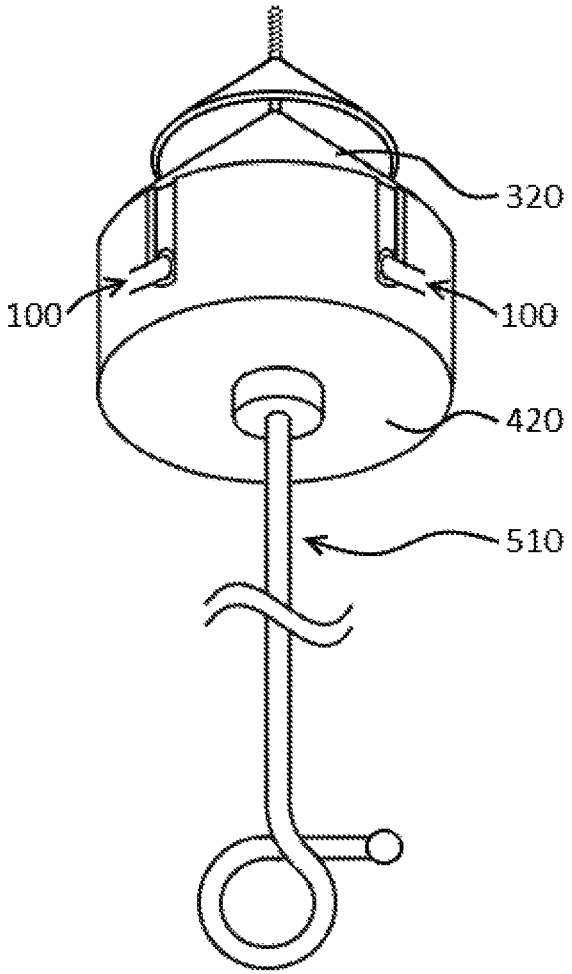
FIG. 11 is a perspective view of the embodiments shown in FIG. 10 assembled together with a pipe connector.

To use a pipe connector 510 to secure the assembly, pass the top screw 511 of a pipe connector 510 through the center hole 412 of the cup lock 420, and screw it into the bottom center screw hole 312 of the hub 320, as shown in FIG. 11.

Figure 12:
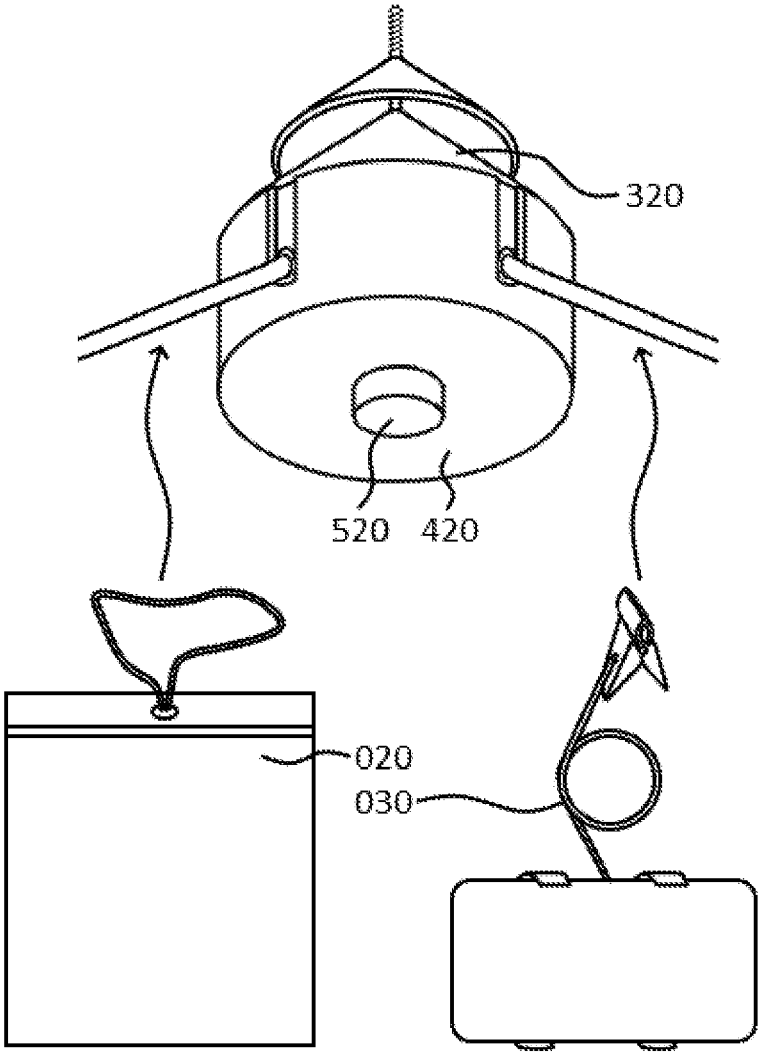
FIG. 12 is a perspective view of the embodiments shown in FIG. 10 assembled together with a hub bottom screw. It also shows a schematic drawing of a mobile device pouch with a strap, and a schematic drawing of a mobile device clip holder.

As shown in FIG. 12, to use a hub bottom screw 520 to secure the assembly, pass a hub bottom screw 520 through the center hole 412 of the cup lock 420, and screw it into the bottom center screw hole 312 of the hub 320. FIG. 12 also shows a schematic drawing of a mobile device pouch 020 with a strap, and a schematic drawing of a mobile device clip holder 030. Mobile device pouches and mobile device clip holders may be attached to the rack poles on the assembled rack.

One can also first assemble the elastic cup ferrules of the poles, a hub, a cup lock and a pipe connector or a hub bottom screw together, and then insert the bottom sections of the poles into the pole holders fixed spaced apart around a floating device.

Figure 13B:
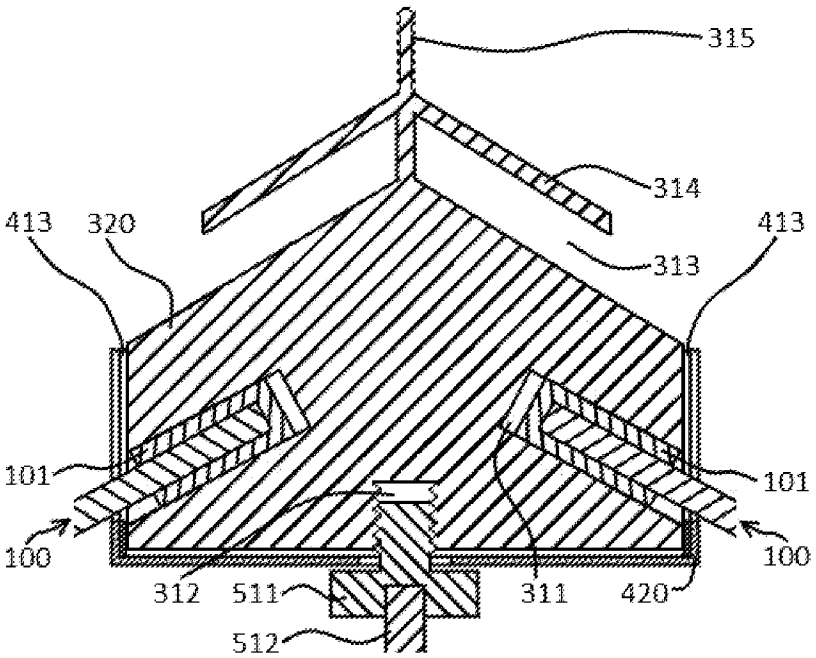
FIG. 13B is a cross-sectional view of the assembled embodiments shown in FIG. 13A.
Figure 13A:
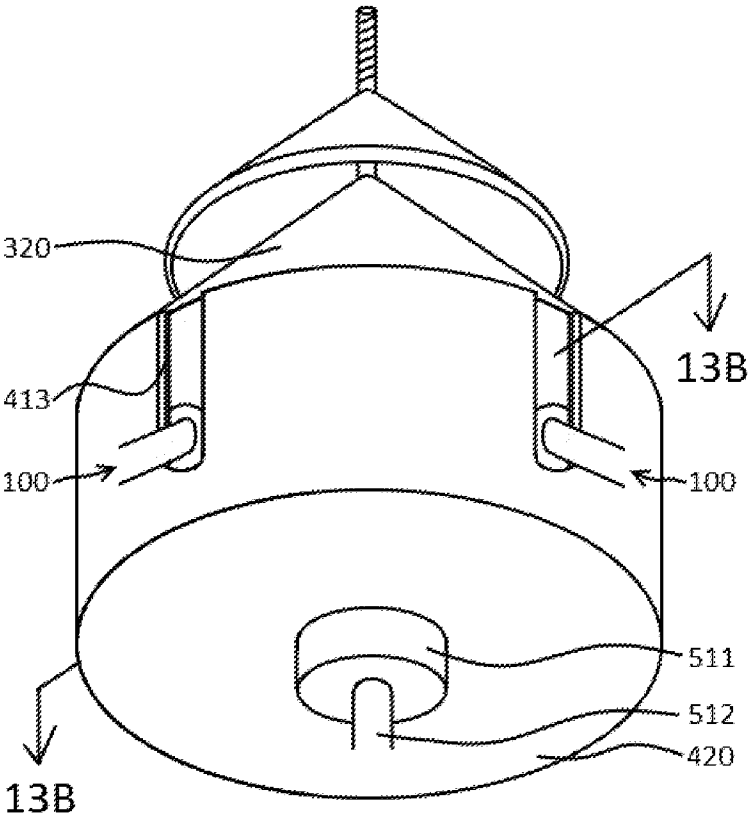
FIG. 13A is a perspective view of the top portion of the assembled embodiments shown in FIG. 11.

FIG. 13A shows the assembled embodiments of a four-receptacle hub 320, a four-gap cup lock 420 covering the hub 320 from the bottom, the elastic cup ferrules 101 locked in the receptacles 311 by the side gaps 411, and a top screw 511 fixed on top of a flexible pipe 512. The section line 13B-13B indicates the cross-sectional view shown in FIG. 13B.

FIG. 13B is a cross-sectional view of the assembled embodiments shown in FIG. 13A, to show the elastic cup ferrules 101 locked inside the receptacles 311, and the top screw 511 fixed on top of a flexible pipe 512 screwed into the bottom center screw hole 312 of the hub 320.

Figure 14:
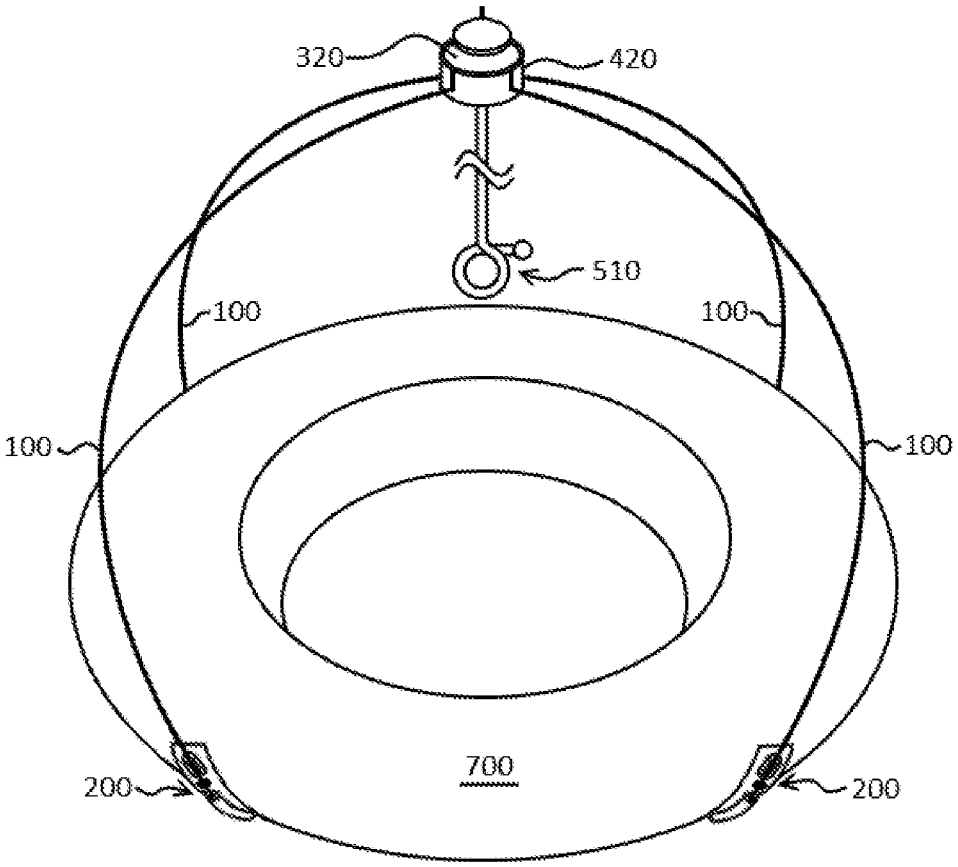
FIG. 14 is a perspective view of an embodiment of a four-pole rack of the present invention assembled on a swim ring.

FIG. 14 shows the embodiment of a four-pole rack assembled with four pole holders 200 fixed spaced apart on a swim ring 700, four rack poles 100, a four-receptacle hub 320, a four-gap cup lock 420 and a pipe connector 510.

Figure 15:
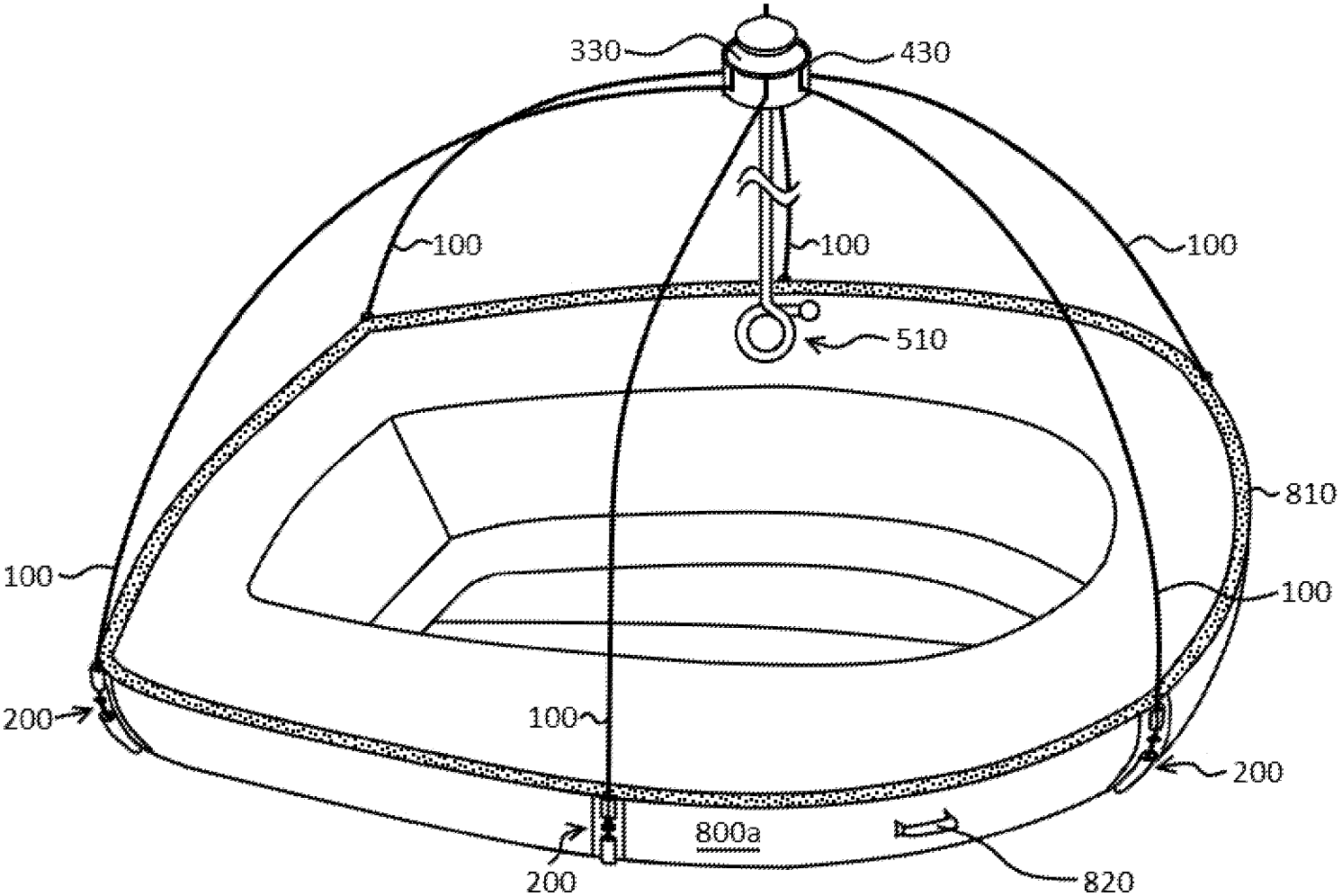
FIG. 15 is a perspective view of an embodiment of a six-pole rack of the present invention assembled on an inflatable boat. It also shows a loop-side belt fixed around the boat top edge.
Figure 16:
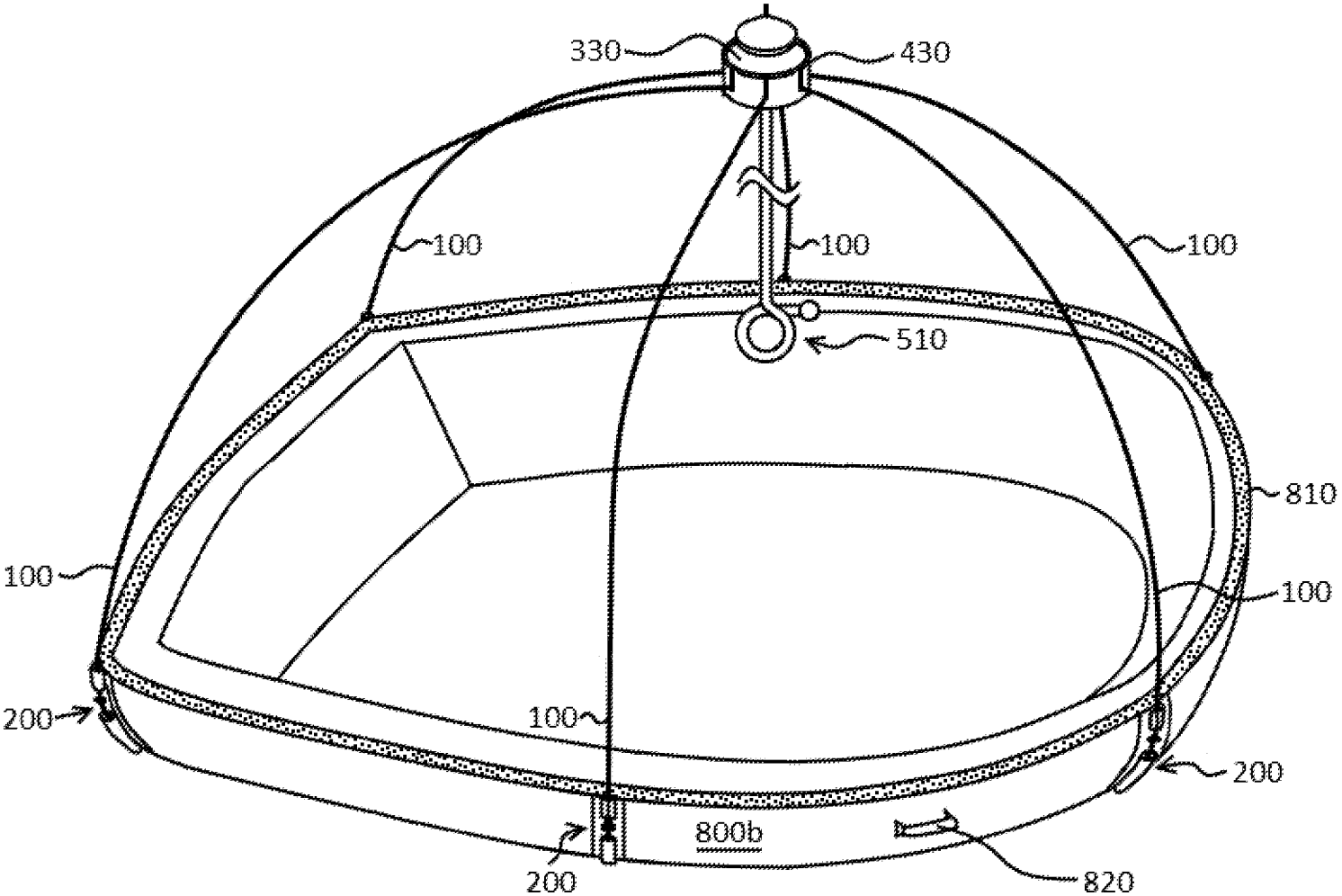
FIG. 16 is a perspective view of an embodiment of a six-pole rack of the present invention assembled on a low-profile hard-hull boat. It also shows a loop-side belt fixed around the boat top edge.

FIG. 15 shows the embodiment of a six-pole rack assembled with six pole holders 200 fixed spaced apart on an inflatable boat 800*a*, six rack poles 100, a six-receptacle hub 330, a six-gap cup lock 430, and a pipe connector 510. FIG. 16 shows the embodiment of a six-pole rack assembled with six pole holders 200 fixed spaced apart on a low-profile hard-hull boat 800*b*, six rack poles 100, a six-receptacle hub 330, a six-gap cup lock 430, and a pipe connector 510.

8) Loop-Side Belt of Hook-and-Loop

For mounting a foldable tent on a multifunctional rack assembled on an inflatable raft or boat or on a low-profile hard-hull boat using hook-and-loop binding, a loop-side belt of hook-and-loop of the present invention made of nylon or other material may be fixed around the top edge of the raft or boat. Handles may be fixed under the loop-side belt. FIG. 15 shows the embodiment of a loop-side belt 810 of hook-and-loop fixed around the top edge of an inflatable boat 800*a*, and a handle 820 fixed under the loop-side belt 810. FIG. 16 shows the embodiment of a loop-side belt 810 of hook-and-loop fixed around the top edge of a low-profile hard-hull boat 800*b*, and a handle 820 fixed under the loop-side belt 810.

9) Foldable Sunshade

A foldable sunshade of the present invention made of nylon or other waterproof material may be secured on a multifunctional rack of the present invention assembled on floating devices, such as inflatable swim rings, rafts or boats, and low-profile hard-hull boats. A foldable sunshade may be designed and made in the shape of triangle, rectangle or other polygon shapes. An elastic strap made of waterproof material is fixed at each corner of a foldable sunshade. A hook is attached at the end of each elastic strap to insert into the bottom opening of the tube of a pole holder. A buckle is attached on each elastic strap to adjust the length of the elastic strap to stretch and secure the foldable sunshade on the rack. The hooks and the buckles may be made of plastics, galvanized steel, stainless steel or other waterproof material. There is a central elastic hole on the foldable sunshade. The elastic hole has an elastic ring made of rubber or other elastic material fixed around the hole. The elastic hole can expand to pass a hub umbrella and then contract to set in the hub groove to prevent water from leaking down. There may be a mobile device bag made of transparent material fixed on the inside side near the perimeter of the foldable sunshade.

Figure 17B:
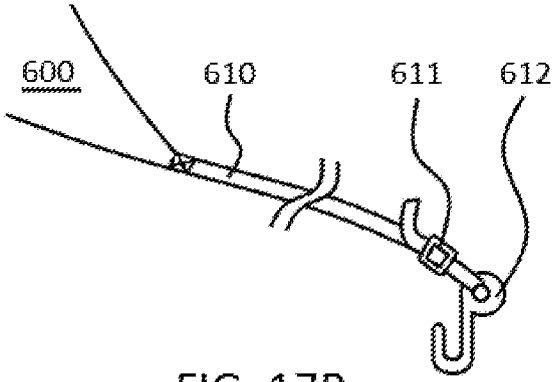
FIG. 17B is an enlarged view of an embodiment of an elastic strap fixed at a corner of the foldable sunshade shown in FIG. 17A.
Figure 17C:
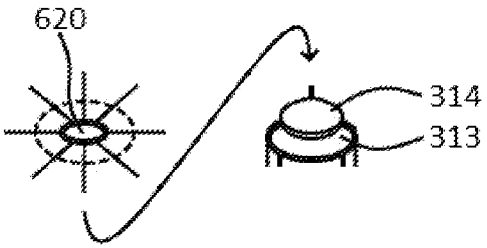
FIG. 17C is an enlarged view of an embodiment of a central elastic hole of the foldable sunshade shown in FIG. 17A.
Figure 17A:
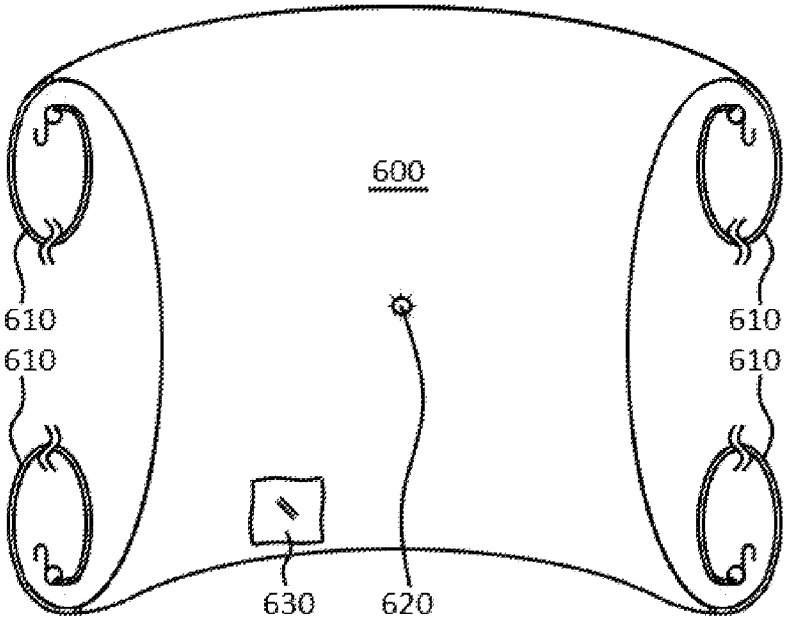
FIG. 17A is a perspective view of an embodiment of a foldable sunshade of the present invention.

FIG. 17A shows the embodiment of a foldable sunshade 600 with elastic straps 610 fixed at each corner, a central elastic hole 620, and a transparent mobile device bag 630 fixed near the perimeter. FIG. 17B is an enlarged view of an embodiment of an elastic strap 610 fixed at a corner of the foldable sunshade 600, to show an embodiment of a buckle 611 attached on the elastic strap 610, and an embodiment of a hook 612 attached at the end of the elastic strap 610. FIG. 17C is an enlarged view of an embodiment of a central elastic hole 620 on the foldable sunshade 600, to show that it can expand to pass a hub umbrella 314 and then set in the hub groove 313.

To secure a foldable sunshade 600 on a multifunctional rack of the present invention, put a foldable sunshade 600 on the multifunctional rack. Push the elastic hole 620 of the foldable sunshade 600 through the hub umbrella 314 to set the elastic hole 620 in the hub groove 313. Stretch the elastic straps 610 and insert each hook 612 into the bottom opening of a tube 205 of a pole holder, as shown in FIG. 2A and FIG. 2B. Adjust the lengths of the elastic straps 610 at the buckles 611 to secure the foldable sunshade on the rack.

Figure 18:
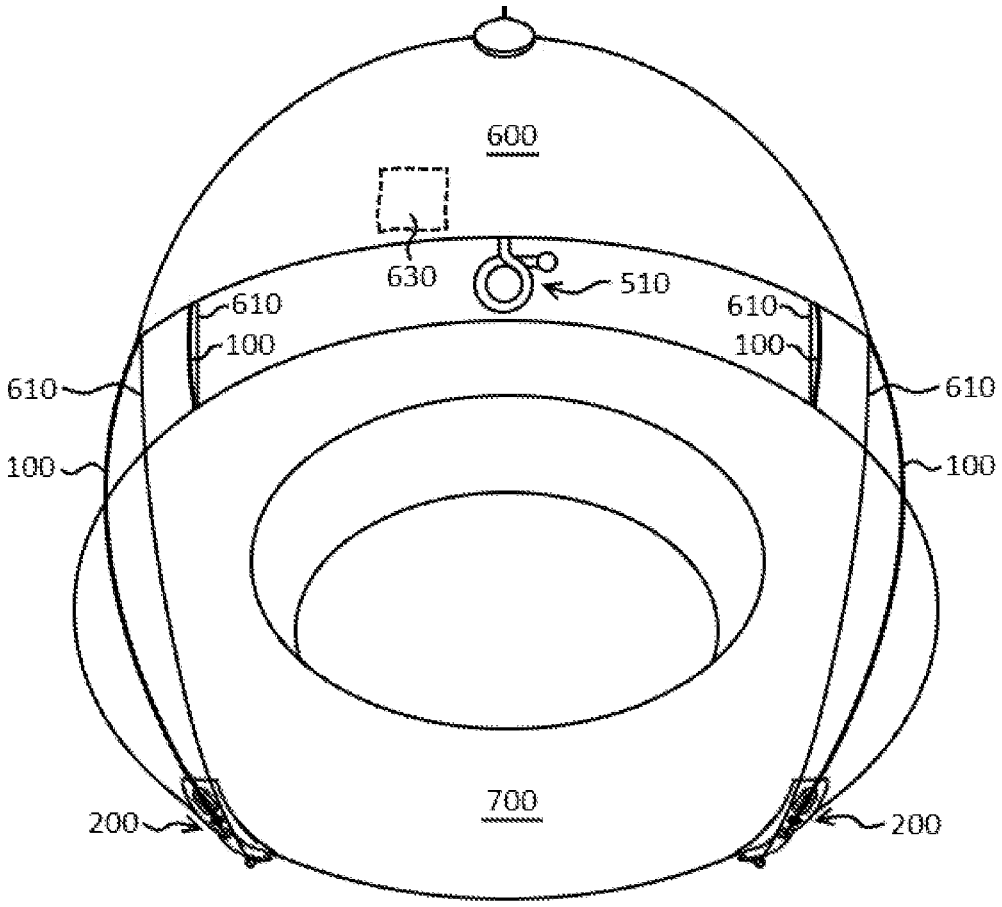
FIG. 18 is a perspective view of an embodiment of a foldable sunshade secured on an embodiment of a four-pole rack of the present invention assembled on a swim ring.
Figure 19:
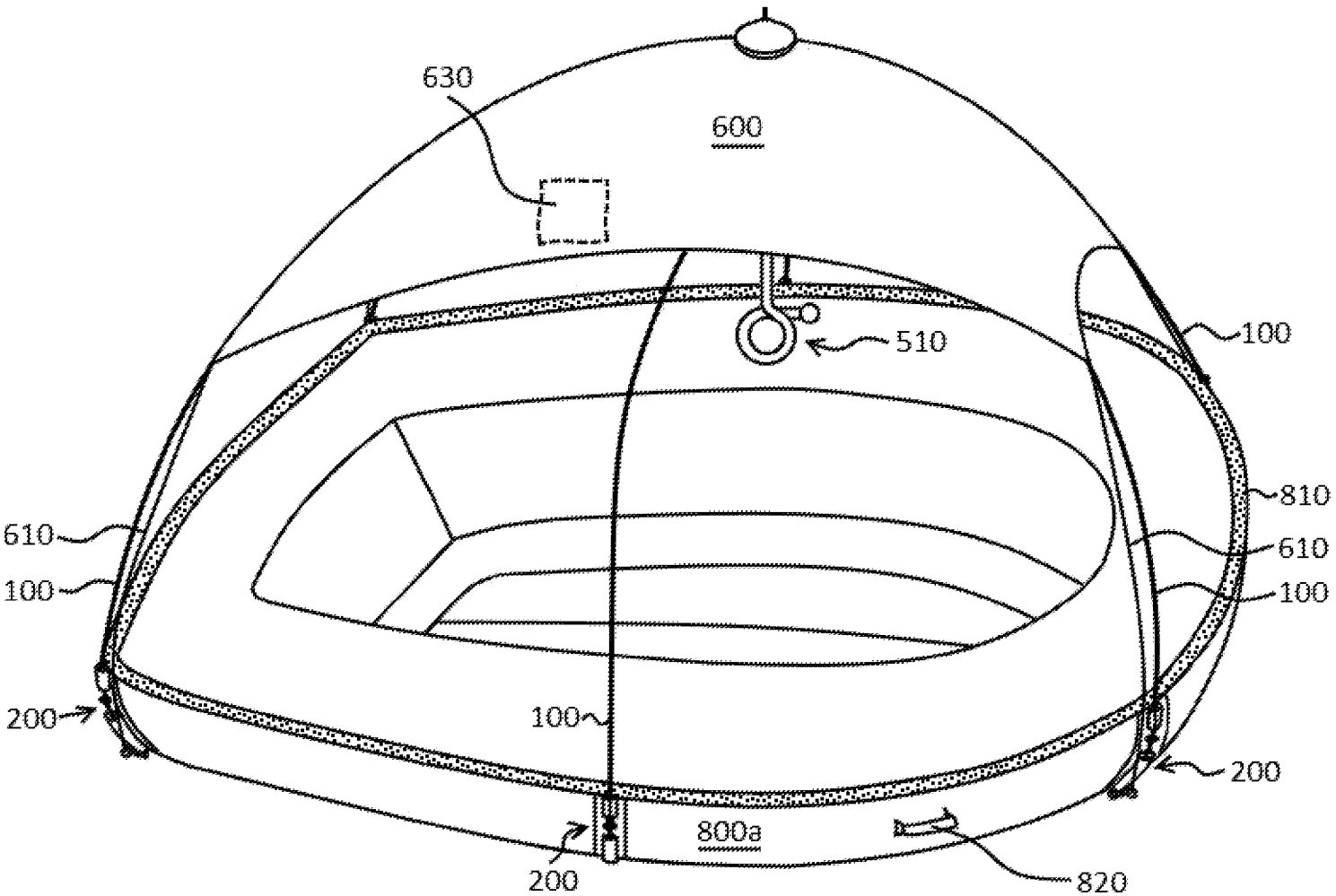
FIG. 19 is a perspective view of an embodiment of a foldable sunshade secured on an embodiment of a six-pole rack of the present invention assembled on an inflatable boat.
Figure 20:
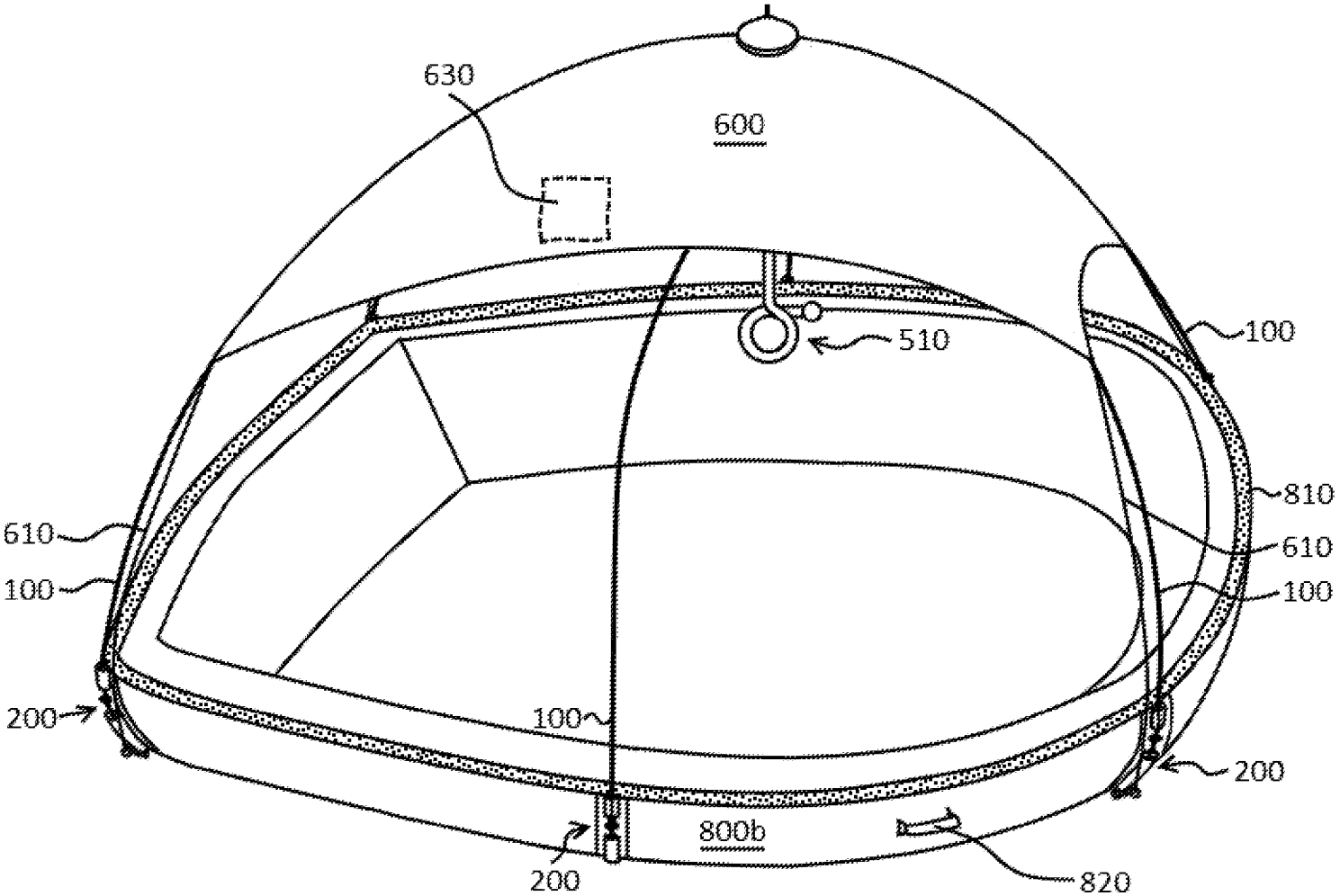
FIG. 20 is a perspective view of an embodiment of a foldable sunshade secured on an embodiment of a six-pole rack of the present invention assembled on a low-profile hard-hull boat.

FIG. 18 shows the embodiment of a foldable sunshade 600 secured on an embodiment of a four-pole rack assembled on a swim ring 700. FIG. 19 shows the embodiment of a foldable sunshade 600 secured on an embodiment of a six-pole rack assembled on an inflatable boat 800*a*. FIG.

20 shows the embodiment of a foldable sunshade 600 secured on an embodiment of a six-pole rack assembled on a low-profile hard-hull boat 800*b*.

10) Foldable Tent

A foldable tent of the present invention may be made of several tarp pieces of nylon or other waterproof material. The foldable tent is made in the shape to fit the shape of a multifunctional rack of the present invention assembled on an inflatable raft or inflatable boat, or on a low-profile hard-hull boat having a loop-side belt of hook-and-loop fixed around the top edge of the raft or boat. There is a top elastic hole on the foldable tent with an elastic ring made of rubber or other elastic material fixed around the hole. The elastic hole can expand to pass the hub umbrella, and then contract to set in the hub groove to prevent water from leaking down.

The foldable tent tarp is designed and made to extend from the top down to the level of the loop-side belt fixed on the raft or boat. A hook-side belt of hook-and-loop made of nylon or other material is fixed at the bottom edge around the tent tarp, with the hook side facing outside. There are slits on the hook-side belt at the positions corresponding to the poles of an assembled rack, to let the hook-side belt pass the rack poles to bind with the loop-side belt fixed on the raft or boat.

There may be a door fixed on the tent tarp. The door may be made of screen cloth, transparent plastics, fabric tarp or other materials, and may be in the shape of rectangle, oval or other shapes. The top of the door may be fixed on the tent tarp, and the door may be connected with the tent tarp on both sides and at the bottom using a zipper or other means. There may be at least one window fixed on the tent tarp. The windows may be made of screen cloth, transparent plastics or other materials, and may be in the shape of rectangle, oval or other shapes. There may be a mobile device bag made of transparent material fixed on the inside side of the tent tarp.

Figure 21:
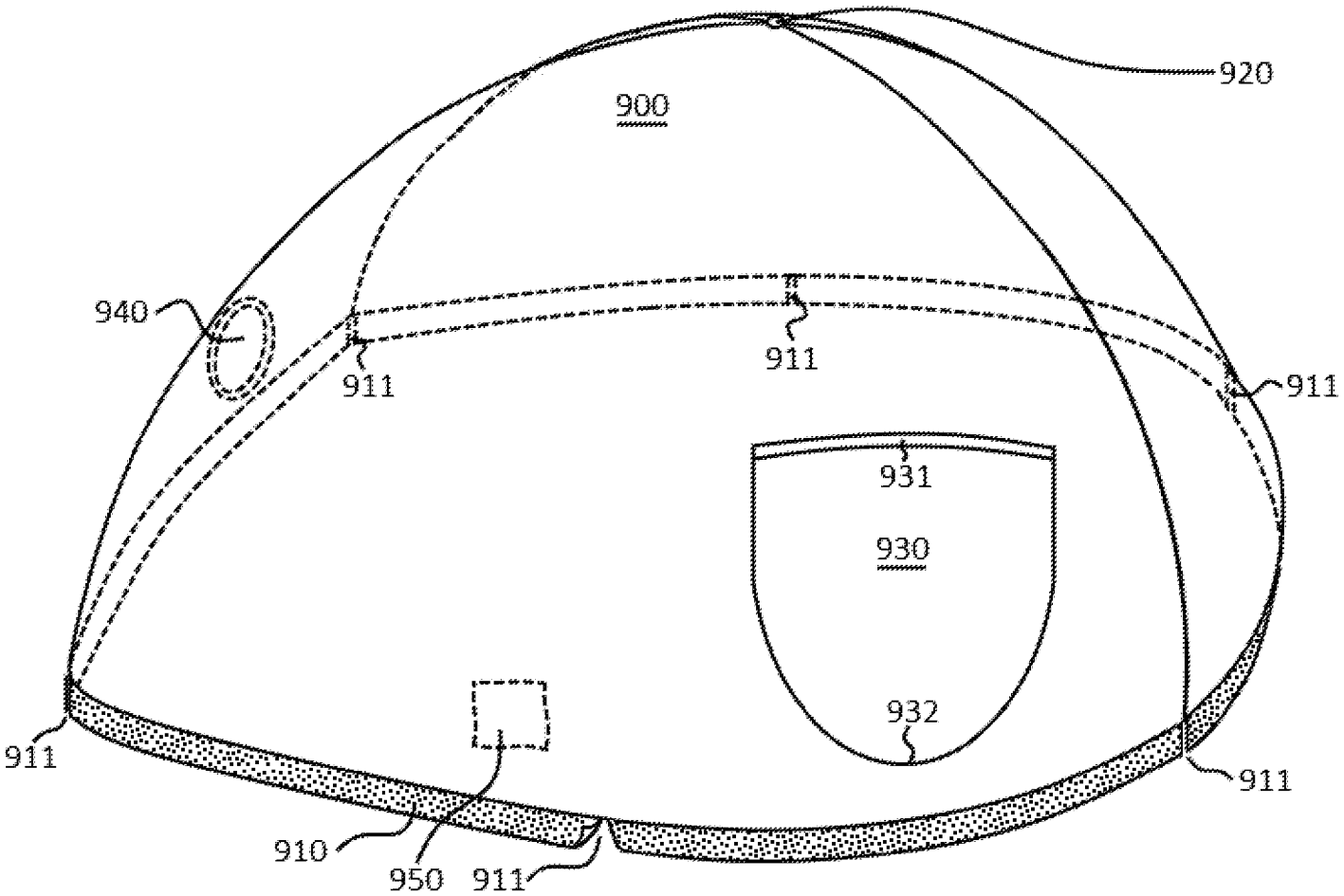
FIG. 21 is a perspective view of an embodiment of a foldable tent of the present invention.

FIG. 21 is a perspective view of the embodiment of a foldable tent 900, to show the hook-side belt 910 fixed around the bottom edge of the tent tarp, with the hook side facing outside, and the slits 911 on the hook-side belt 910. It also shows a top elastic hole 920, a U-shaped door 930 with top attachment 931 fixed on the tent tarp and a door zipper 932, a window 940 and a transparent mobile device bag 950 fixed on the inside side of the tent tarp.

To mount a foldable tent 900 on a multifunctional rack of the present invention assembled on an inflatable boat 800*a* or on a low-profile hard-hull boat 800*b*, put the foldable tent 900 on the rack. Push the elastic hole 920 through the hub umbrella 314 to set the elastic hole 920 in the hub groove 313. Stretch the tent tarp with hook-side belt 910 down outside the rack around the boat, ensuring that the slits 911 on the hook-side belt 910 fit to the corresponding rack poles 100, and the tent tarp extends down to the level of the loop-side belt 810 fixed on the boat.

Figure 22:
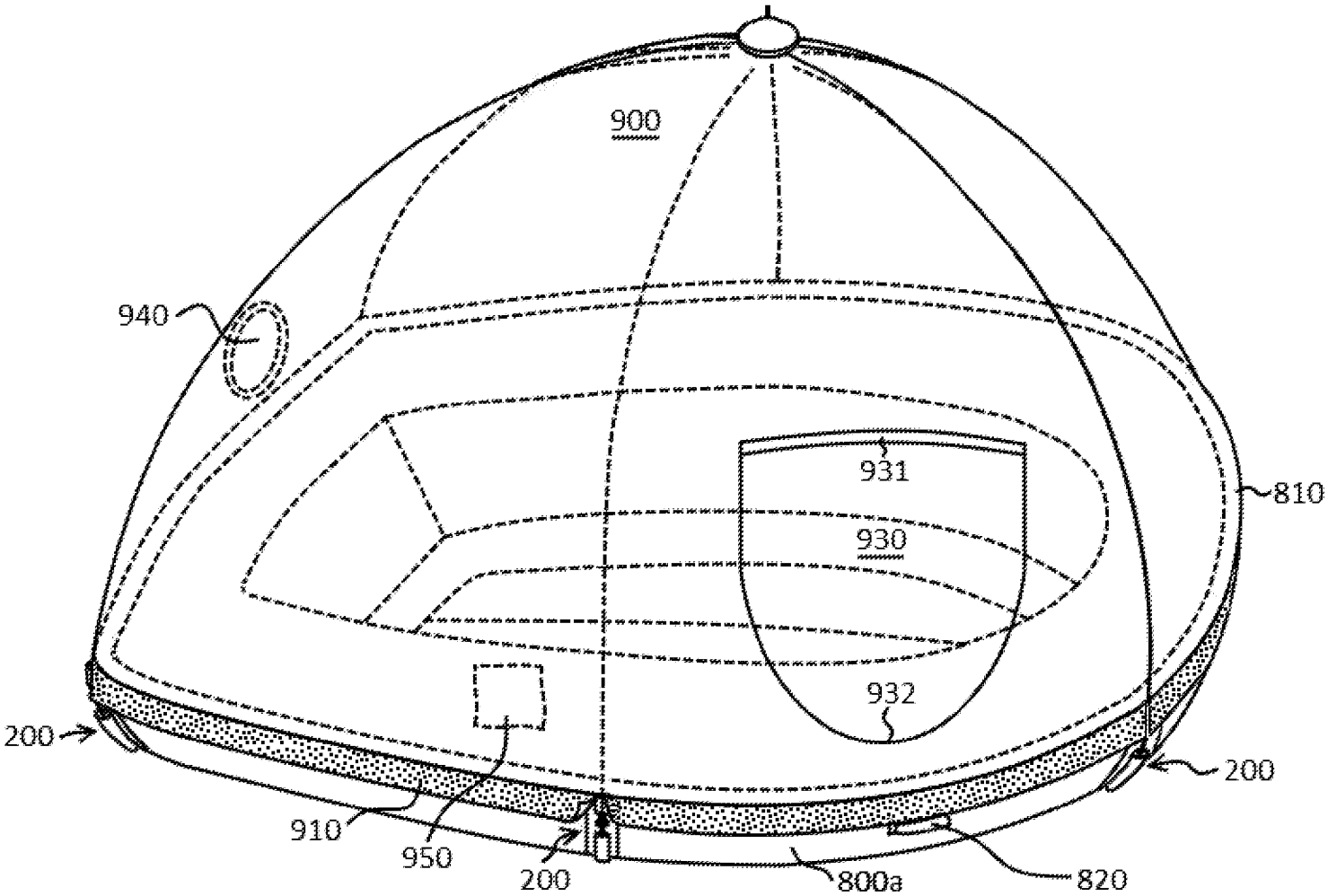
FIG. 22 is a perspective view of an embodiment of a foldable tent shown in FIG. 21 put on an embodiment of a six-pole rack of the present invention assembled on an inflatable boat.
Figure 23:
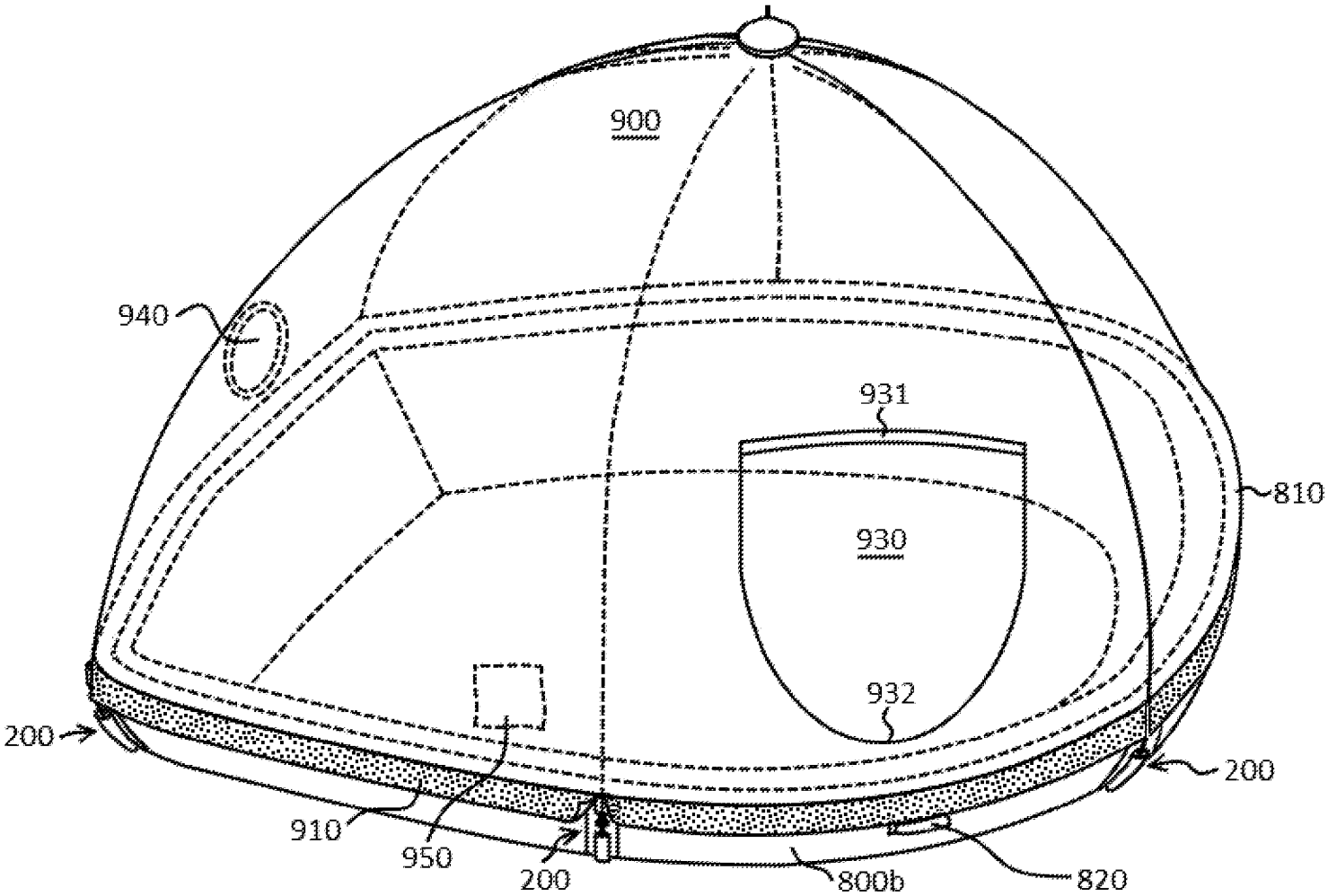
FIG. 23 is a perspective view of an embodiment of a foldable tent shown in FIG. 21 put on an embodiment of a six-pole rack of the present invention assembled on a low-profile hard-hull boat.
Figure 24A:
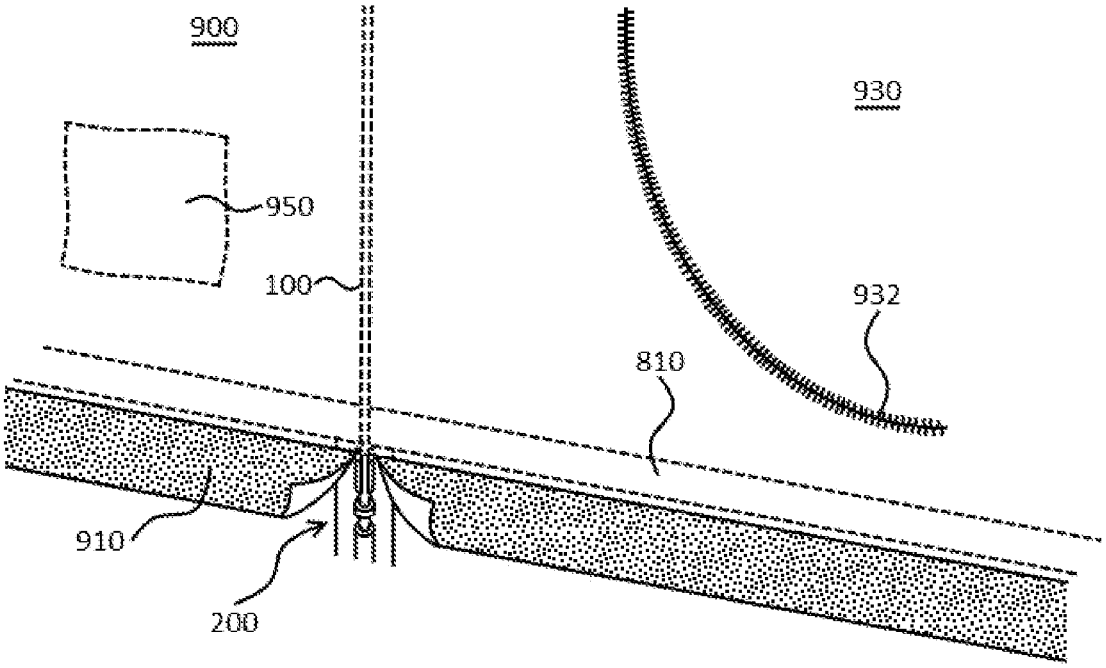
FIG. 24A is a partial enlarged perspective view of the embodiment of a foldable tent shown in FIG. 22 at the position of the side middle pole.

FIG. 22 is a perspective view of an embodiment of a foldable tent 900 shown in FIG. 21 put on an embodiment of a six-pole rack assembled on an inflatable boat 800*a*. FIG. 23 is a perspective view of an embodiment of a foldable tent 900 shown in FIG. 21 put on an embodiment of a six-pole rack assembled on a low-profile hard-hull boat 800*b*. FIG. 24A is a partial enlarged perspective view of the embodiment of a foldable tent 900 shown in FIG. 22 at the position of the side middle pole, to show that the tent tarp extends down to the level of the loop-side belt 810 fixed on the boat 800*a*.

Figure 24B:
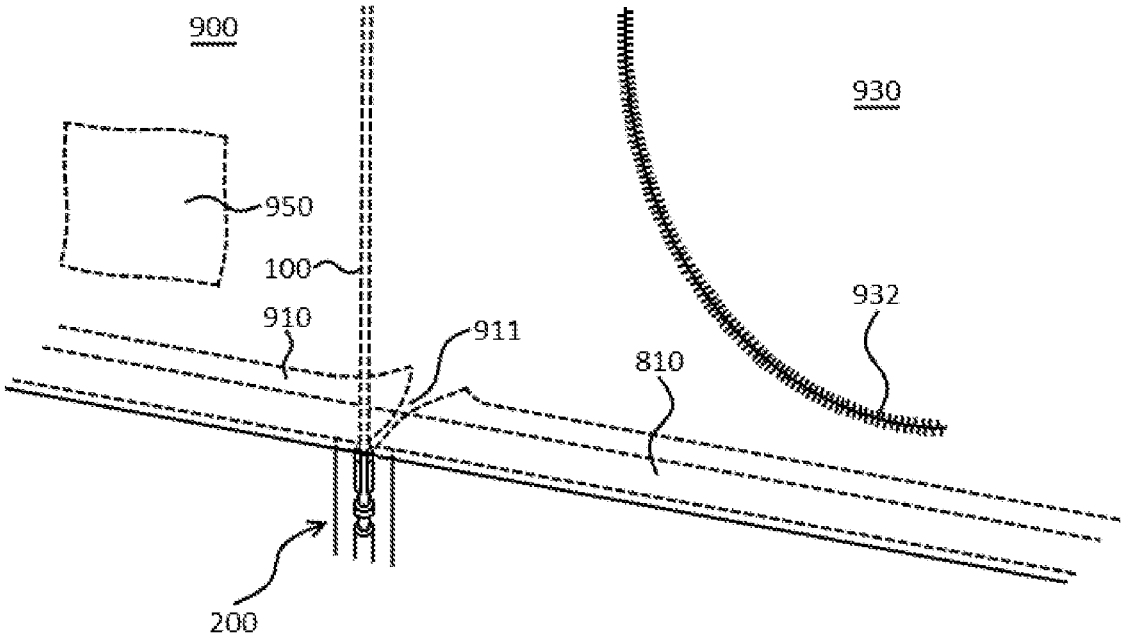
FIG. 24B is a partial enlarged perspective view of the embodiment of a foldable tent shown in FIG. 24A, showing the hook-side belt of the tent bent inward.
Figure 24C:
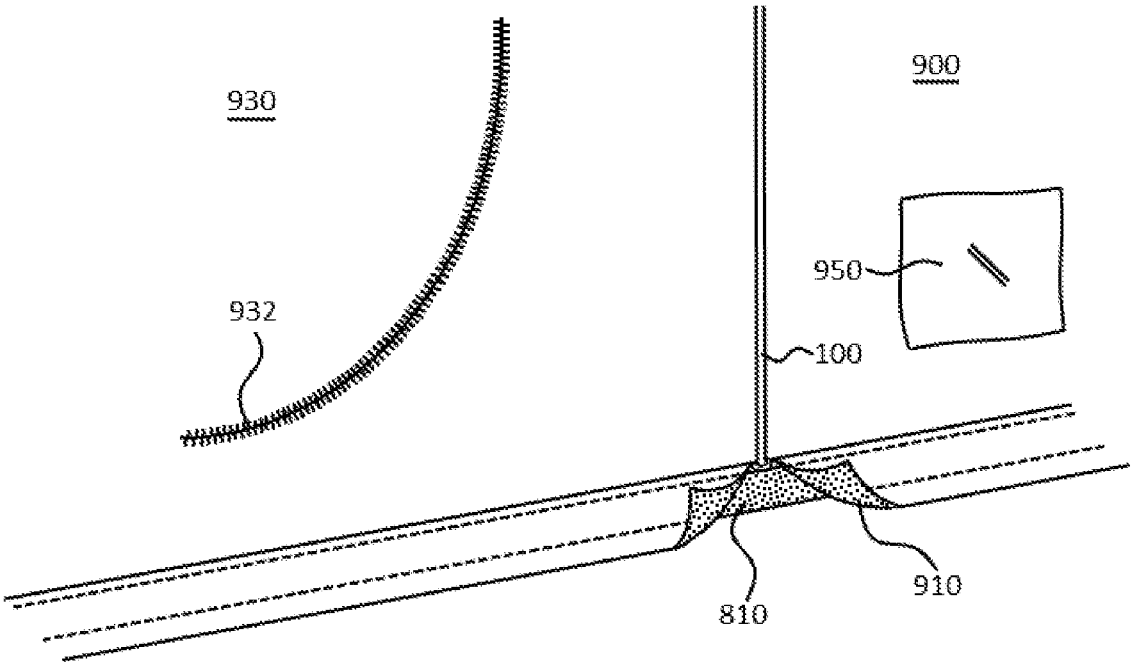
FIG. 24C is an inside partial enlarged perspective view of the embodiment of a foldable tent shown in FIG. 24B, showing the tent hook-side belt bound with the boat loop-side belt.

To bind the tent hook-side belt 910 with the boat loop-side belt 810, referring to FIG. 24B, bend the tent hook-side belt 910 inward and pass the rack poles 100 through the slits 911 to pull the tent hook-side belt 910 inside the tent, and bind the tent hook-side belt 910 in the tent with the boat loop-side belt 810, as shown in FIG. 24C.

Figure 25:
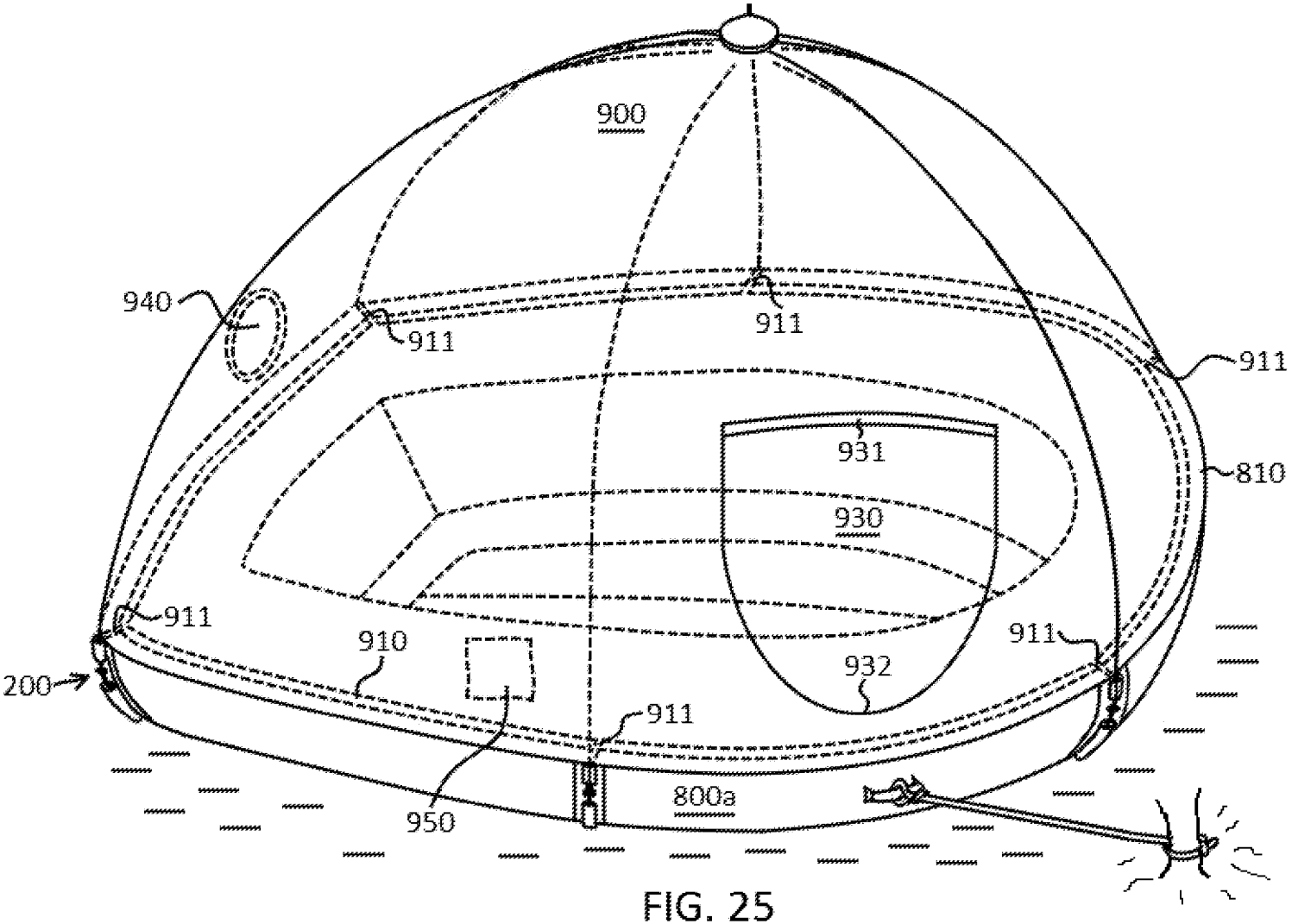
FIG. 25 is a perspective view of an embodiment of a foldable tent mounted on an embodiment of a six-pole rack of the present invention assembled on an inflatable boat.
Figure 26:
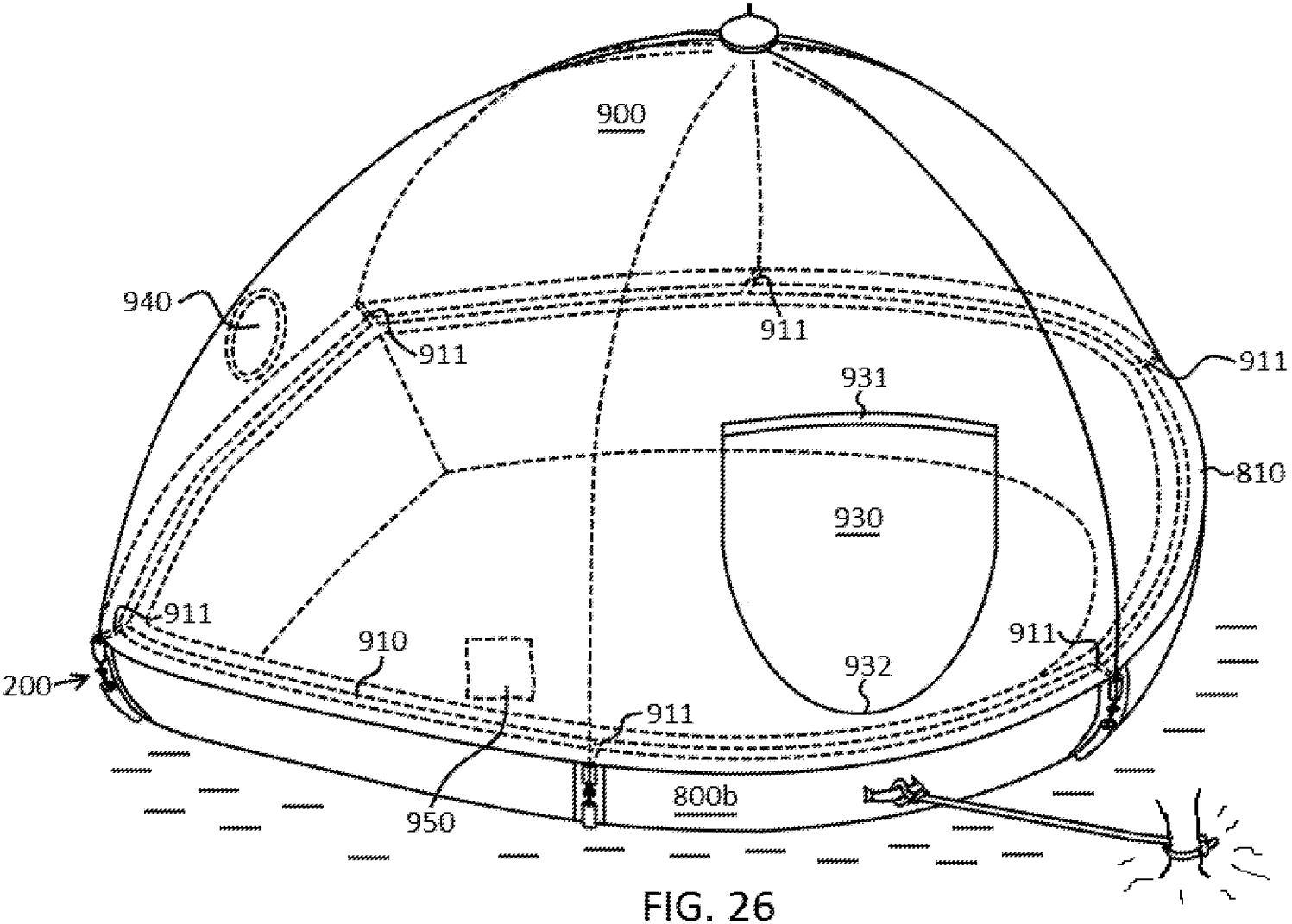
FIG. 26 is a perspective view of an embodiment of a foldable tent mounted on an embodiment of a six-pole rack of the present invention assembled on a low-profile hard-hull boat.

FIG. 25 is a perspective view of an embodiment of a foldable tent 900 shown in FIG. 21 mounted on an embodiment of a six-pole rack assembled on an inflatable boat 800*a*. FIG. 26 is a perspective view of an embodiment of a foldable tent 900 shown in FIG. 21 mounted on an embodiment of a six-pole rack assembled on a low-profile hard-hull boat 800*b*. Both views illustrate that the hook-and-loop binding around the boat forms a closed tent space on the boat.

BRIEF LIST OF REFERENCE NUMBERS USED IN THE DRAWINGS

100 rack pole
101 rack pole elastic cup ferrule
102 rack pole small knot
103 rack pole bottom section
200 pole holder
201 pole holder base piece
202 pole holder blocker
425 203 pole holder blocker narrow opening
204 pole holder gap
205 pole holder tube
310 three-receptacle hub
311 hub receptacle
312 hub bottom center screw hole
313 hub groove
314 hub umbrella
315 hub thread column
320 four-receptacle hub
330 six-receptacle hub
410 three-gap cup lock
411 cup lock gap
412 cup lock center hole
413 cup lock inner side elastic coating layer
420 four-gap cup lock
430 six-gap cup lock
510 pipe connector
511 pipe connector top screw
512 pipe connector flexible pipe
513 pipe connector bottom ball
520 hub bottom screw
600 foldable sunshade
610 foldable sunshade elastic strap
611 foldable sunshade buckle
612 foldable sunshade hook
620 foldable sunshade central elastic hole
630 foldable sunshade mobile device bag
700 swim ring
800*a* inflatable boat
800*b* low-profile hard-hull boat
810 boat loop-side belt of hook-and-loop
820 handle
900 foldable tent
910 foldable tent hook-side belt of hook-and-loop
911 foldable tent hook-side belt slit
920 foldable tent top elastic hole
930 foldable tent door
931 foldable tent door attachment on the tent tarp
932 foldable tent door zipper
940 foldable tent window
950 foldable tent mobile device bag

010 schematic drawing of a mobile device holder with a ball joint

020 schematic drawing of a mobile device pouch with a strap

030 schematic drawing of a mobile device clip holder

The invention claimed is:

1. A device for supporting a shade comprising:

a plurality of poles each having first and second opposed ends, and a widened end portion at the first end;

a hub forming a body defining a perimeter having a receptacle for each of the plurality of poles, each receptacle sized to admit insertion of the widened end portion of a pole; and a blocking body forming a perimeter side wall and an open end, the side wall sized and shaped to be mateable to nest with the hub, the blocking body having a plurality of slots each extending along the blocking body perimeter, each slot open at the open end, each slot having a width wider than each of the plurality of poles and a width narrower than the widened end portion of each of the plurality of poles;

the blocking body sized and dimensioned to be nestable with the hub after the widened end portion of each of the plurality of poles is inserted into a receptacle, each slot of the blocking body sized and dimensioned to admit passage of a pole, the perimeter of the blocking body surrounding each of the widened end portions and sized and dimensioned to thereby prevent movement of each of the widened end portions out of the receptacle into which the widened end portion has been inserted and through the slot through which the pole has been passed, the nested blocking body thereby preventing each of the plurality of poles from moving out of the receptacle into which it has been inserted; and a flexible rod fastenable to the blocking body and hub and having a ball portion at a distal end.

2. The device of claim 1, the widened end portion formed by a elastic ferrule connected to the first end of each of the plurality of poles.

3. The device of claim 1, the receptacles angled from horizontal to define a non-orthogonal angular orientation of each of the poles with respect to horizontal when a pole is inserted into a receptacle.

4. The device of claim 1, the flexible rod threadably fastenable to the hub and passable through the blocking body to affix the blocking body to the hub.

5. The device of claim 1, further including a shade covering positionable over the hub and at least a portion of each of the plurality of poles when the plurality of poles are inserted into receptacles of the hub.

6. The device of claim 5, the shade covering connected to a plurality of straps, each of the straps having an attached hook.

7. The device of claim 5, further including a hub cover affixable to the hub to form a gap therebetween, the shade covering having an elastic opening, the shade covering opening expandable to pass over the hub cover and to be retained within the gap.

8. The device of claim 1, the second end of each of the plurality of poles having a widened portion, the pole holders including a tube into which the second end of a pole is inserted, and a blocker spaced apart from the tube, the widened portion at the second end positionable between the tube and the blocker.

9. A kit including the device of claim 1, a plurality of the poles separated from the hub, and a shade covering positionable over the hub and at least a portion of each of the plurality of poles when the plurality of poles are inserted into receptacles of the hub.

10. The kit of claim 9, the shade covering including a peripheral hook and loop fabric strip portion connectable to a bottom layer when the device is positioned onto a bottom layer with a mating hook and loop fabric strip portion, whereby the device is formed into a tent together with the bottom layer.

11. A rack mountable upon a floating device, comprising:

at least three poles that are flexible, each having a widened ferrule affixed upon a top end of the pole;

at least three pole holders each having a base attachable to the floating device and having a tube positioned upon the base and sized and dimensioned to accept insertion of a bottom end of one of the at least three poles;

a hub having a threaded fastener at bottom end and at least three receptacles each sized and dimensioned to accept insertion of a top end and ferrule of one of the at least three poles;

a hub cover sized and dimensioned to be affixed above the hub to form a peripheral gap between the hub cover and the hub;

a cup lock sized and dimensioned to overlap the hub when assembled onto a bottom end of the hub, the cup lock having at least three side gaps each corresponding to one of the plurality of receptacles, the cup lock having a center aperture;

an elongate connector formed of a material that is bendable to maintain a bent configuration, the elongate connector having a threaded fastener at a top end threadably connectable to the threaded fastener of the hub, the elongate connector having a ball positioned at a bottom end of the elongate connector, the ball sized and dimensioned to form a part of a ball joint of a mobile electronic device holder.

12. The rack of claim 11, the widened ferrule formed of an elastic material.

13. The rack of claim 11, each pole having a widened portion at a bottom end of the pole, each pole holder including a blocking spaced apart from the tube, the widened portion of a pole positionable between the tube and the blocker.

14. The rack of claim 11, the plurality of receptacles being angled downwards with respect to horizontal when the rack is mounted upon a floating device.

15. The rack of claim 11, the hub having a conical top end shape, the hub cover having an umbrella shape mateable with the conical top end shape of the hub.

16. The rack of claim 11, the cup lock having an inner surface that is elastic to improve a grip with the hub when the cup lock is overlapped onto the hub.

17. A device for providing shade upon a floating device, comprising:

a plurality of flexible poles each having first and second opposed ends;

a hub having a plurality of receptacles each sized to admit insertion of pole;

a plurality of pole holders fastenable to the floating device, a second end of each pole connectable to a pole holder to thereby suspend the hub above the floating device; and an elongate support connected to the hub to extend downwards from a lower surface of the hub when the hub is suspended above the floating base, the elongate support having an end distal from the hub including a ball sized and dimensioned to form a part of a ball joint of a mobile electronic device holder, the elongate support being rigid and bendable to maintain a bent shape when a mobile electronic device is supported by the elongate support.

18. The device of claim 17, further including:

a shade including an opening, the shade positionable above the hub and above the flexible poles when the poles are inserted in the hub with the opening above the hub;

a hub cover positionable over the shade to cover the opening, a fastener connecting the hub cover and hub and passing through the opening.

19. The device of claim 17, further including a blocking device mateable with the hub to maintain each pole within a receptacle.

* * * * *